US006901899B2

(12) United States Patent
Tsunoda et al.

(10) Patent No.: US 6,901,899 B2
(45) Date of Patent: Jun. 7, 2005

(54) RECOIL STARTER

(75) Inventors: Shuhei Tsunoda, Tokyo (JP); Toshinori Morishige, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 10/688,649

(22) Filed: Oct. 17, 2003

(65) Prior Publication Data

US 2004/0084004 A1 May 6, 2004

(30) Foreign Application Priority Data

Oct. 21, 2002 (JP) ..... 2002-306297
Feb. 17, 2003 (JP) ..... 2003-038885

(51) Int. Cl.[7] ..... F02N 3/02; F02N 5/02
(52) U.S. Cl. ..... 123/185.14; 123/185.3
(58) Field of Search ..... 123/185.2, 185.3, 123/185.4, 185.14

(56) References Cited

U.S. PATENT DOCUMENTS 3,306,277 A 2/1967 Gudmundsen
5,287,832 A 2/1994 Uhl
5,970,940 A 10/1999 Penton
6,508,220 B1 1/2003 Akaike et al.
2002/0121257 A1 9/2002 Morishige et al.
2003/0015162 A1 1/2003 Harada et al.

FOREIGN PATENT DOCUMENTS

JP 2001-132591 5/2001

*Primary Examiner*—Andrew M. Dolinar

(57) ABSTRACT

A recoil starter capable of readily staring an engine and reducing the number of components and manufacturing costs thereof and reducing a size and weight thereof. The recoil starter is so constructed that a rotational force accumulated in a cushioning and force accumulating means interposed between a rope reel and a cam is transmitted via the cam to a drive pulley, to thereby start the engine. A ratchet mechanism is provided between the rope reel and the cam so as to uncouple the cam from the rope reel when the rope reel is rotated in an engine starting direction and so as to couple the cam to the rope reel when the rope reel is rotated in a direction opposite to the engine starting direction, thus rotating the cam and the rope reel together in said opposite direction.

20 Claims, 14 Drawing Sheets

RECOIL STARTER

BACKGROUND OF THE INVENTION

1. Field of the Invention

The present invention relates to a recoil starter, wherein a recoil rope is pulled to rotate a rope reel so that a rotation of the rope reel is transmitted to a drive pulley coupled to a crankshaft of an engine via a clutch mechanism such as a centrifugal clutch to thereby rotate the drive pulley, resulting in the engine being started.

2. Description of the Related Art

Among recoil starters where a rope reel is rotated by pulling a recoil rope wound around the rope reel, and a rotation of a cam rotated by a rotation of the rope reel is transmitted to a rotating member such as a flywheel magnet or a drive pulley that is coupled to a crankshaft of an engine via a clutch mechanism such as a centrifugal clutch, so that the crankshaft of the engine is rotated to start the engine, a recoil starter is known which is so constructed that a cushioning and force accumulating means is disposed between the rope reel and the cam so as to prevent shock due to abrupt load fluctuations on the engine side from being transmitted to the rope reel side and so as to facilitate starting of the engine by accumulating a rotational force of the rope reel in the cushioning and force accumulating means and releasing the rotational force accumulated in the cushioning and force accumulating means (see, e.g., Japanese Patent Application Laid-Open Publication No. 2001-132591).

In this conventional recoil starter, the rope reel rotated by pulling the recoil rope, the cam that transmits the rotation to the drive pulley coupled to the crankshaft of the engine via the clutch mechanism and a spring case that houses a spring as the cushioning and force accumulating means are each rotatably supported by a shaft formed within a casing. Additionally, a one-way ratchet mechanism is provided between the rope reel and the spring case such that the rotation of the rope reel in an engine starting direction is transmitted to the spring case. When the rope reel is rotated by pulling the recoil rope, the spring case is rotated together via the one-way ratchet mechanism, transmitting the rotation of the rope reel to the drive pulley via the spring case. When the drive pulley stops rotating due to a starting resistance of the engine, a rotational force of the rope reel is accumulated in the spring. Further, a one-way clutch is provided between the shaft and the spring case to prevent rotation of the spring case in the opposite direction.

In this conventional recoil starter, the spring case housing the cushioning and force accumulating means or spring, the rope reel around which the recoil rope is wound and the drive pulley for transmitting the rotational force to the crankshaft of the engine are each supported by the shaft within the casing; the one-way ratchet mechanism is provided between the rope reel and the spring case so as to transmit the rotation of the rope reel in the engine starting direction to the spring case; and the one-way clutch is provided between the spring case and the shaft to allow rotation of the spring case only in the engine starting direction, with the result that the manufacturing costs of the recoil starter are increased due to a large number of components required and a complex configuration of the components and a reduction in size and weight of the recoil starter is precluded due to large outer dimensions of the recoil starter, and particularly axial dimensions thereof.

SUMMARY OF THE INVENTION

The present invention has been made in view of the foregoing problems.

Accordingly, it is an object of the present invention to provide a recoil starter that is equipped with a cushioning and force accumulating means and capable of readily starting an engine and that can achieve not only a reduction in the number of components and the manufacturing costs thereof but also a reduction in size and weight thereof.

In accordance with the present invention, there is provided a recoil starter. The recoil starter comprises: a casing having a reel shaft formed therein and adapted to be mounted to an engine; a rope reel rotatably supported on the reel shaft and provided on an outer periphery thereof with a drum portion around which a recoil rope is wound; a recoil spring for rotationally urging the rope reel in a direction in which the recoil rope is rewound; a cam engageable, via a clutch mechanism, with a drive pulley coupled to the engine, for transmitting a rotation thereof to the drive pulley; and a cushioning and force accumulating means interposed between the rope reel and the cam, a rotational force of the rope reel accumulated in the cushioning and force accumulating means being transmitted via the cam to the drive pulley, to thereby start the engine; wherein a ratchet mechanism is provided between the rope reel and the cam such that, when the rope reel is rotated in an engine starting direction, the ratchet mechanism uncouples the rope reel and the cam from each other, and when the rope reel is rotated in the direction opposite to the engine starting direction by the rotational force accumulated in the recoil spring, the ratchet mechanism couples the rope reel and the cam to each other so that the cam is rotated together with the rope reel in said opposite direction.

Preferably, the clutch mechanism comprises a centrifugal clutch disposed on the drive pulley and provided with a centrifugal ratchet that operates to disengage from the cam by a centrifugal force.

Alternatively, the clutch mechanism may comprise a one-way clutch provided with a ratchet that is provided on the cam so as to engage with or disengage from an engagement portion formed on the drive pulley.

In a preferred embodiment of the present invention, the cushioning and force accumulating means comprises a spiral spring that has one end thereof held on the rope reel and the other end thereof held on the cam.

In a preferred embodiment of the present invention, the ratchet mechanism includes a ratchet member having a ratchet pawl integrally formed thereon to be engageable with an engagement member formed on an outer periphery of the cam, and an operating member having an operating piece for operating the ratchet member to rotate it, the ratchet member and the operating member each being pivotally supported on a side surface of an outer peripheral portion of the rope reel; the operating piece is formed on the operating member so as to pivotally rotate the operating member by engaging with one of cutout grooves formed on an inner circumference surface of an outer wall of the casing; when the rope reel is rotated in the engine starting direction, the operating piece of the operating member engages with one of the cutout grooves, to thereby pivotally rotate the operating member in a direction in which the ratchet pawl is disengaged from the engagement member; and when the rope reel is rotated in the direction in which the recoil rope is rewound, the operating piece of the operating member engages with one of the cutout grooves, to thereby pivotally rotate the operating member in a direction in which the ratchet pawl of the ratchet member is engaged with the engagement member of the cam.

The ratchet mechanism may comprise a ratchet member swingably supported on a side surface of an outer peripheral portion of the rope reel and provided with a ratchet pawl engageable with an engagement member formed on an outer periphery of the cam, and a biasing means for biasing the ratchet member such that the ratchet member comes into contact with and slides on an inner circumferential surface of an outer wall of the casing; when the rope reel is rotated in the engine starting direction, the ratchet member swings due to friction between the ratchet member and the inner circumferential surface of the casing such that the ratchet pawl is disengaged from the engagement member of the cam; and when the rope reel is rotated in the direction in which the recoil rope is rewound, the ratchet member swings due to the friction between the ratchet member and the inner circumferential surface of the casing such that the ratchet pawl is engaged with the engagement member of the cam.

Alternatively, the ratchet mechanism may comprise a ratchet member pivotally supported on a side surface of the rope reel via a pivot and provided at one end thereof with a ratchet pawl engageable with an engagement member formed on an outer periphery of the cam, and a biasing spring piece having a curved shape and supported at opposite ends thereof on the ratchet member while a curved portion of the biasing spring piece is kept in sliding contact with an inner circumferential surface of an outer wall of the casing; when the rope reel is rotated in the engine starting direction, the ratchet pawl is disengaged from the engagement member of the cam due to a sliding resistance between the curved portion of the biasing spring piece and the inner circumferential surface of the casing; and when the rope reel is rotated in the direction in which the recoil rope is rewound, the ratchet member is pivotally rotated about the pivot due to the sliding resistance between the curved portion of the biasing spring piece and the inner circumferential surface of the casing such that the ratchet pawl is engaged with the engagement member of the cam.

BRIEF DESCRIPTION OF THE DRAWINGS

The above and other objects, aspects, features and advantages of the present invention will become more apparent from the following detailed description when taken in conjunction with the accompanying drawings, in which.

DETAILED DESCRIPTION OF THE INVENTION

Embodiments of the present invention will now be described below with reference to the accompanying drawings.

Figure 1:
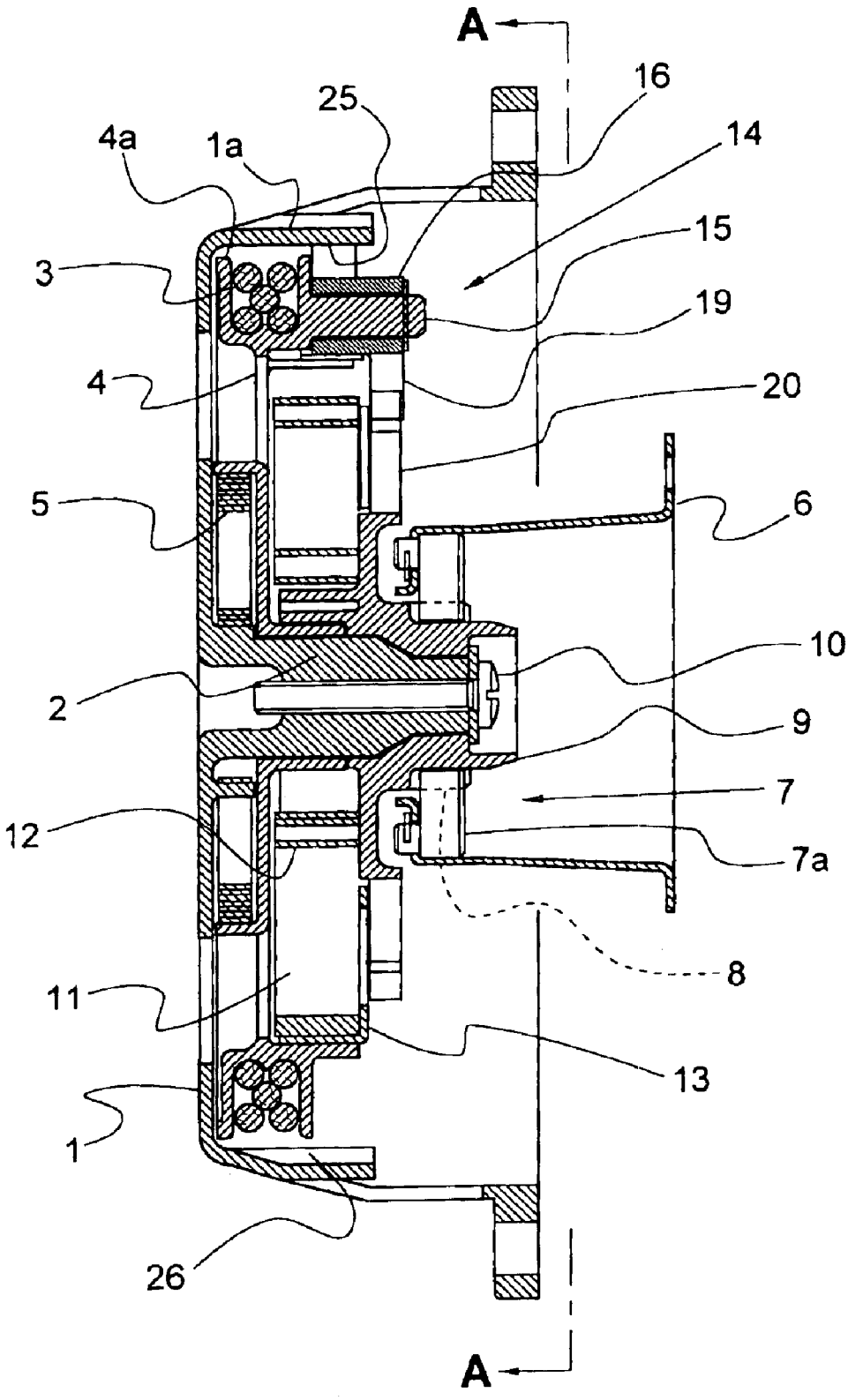
FIG. 1 is a sectional side elevation view showing a recoil starter according to an embodiment of the present invention.
Figure 2:
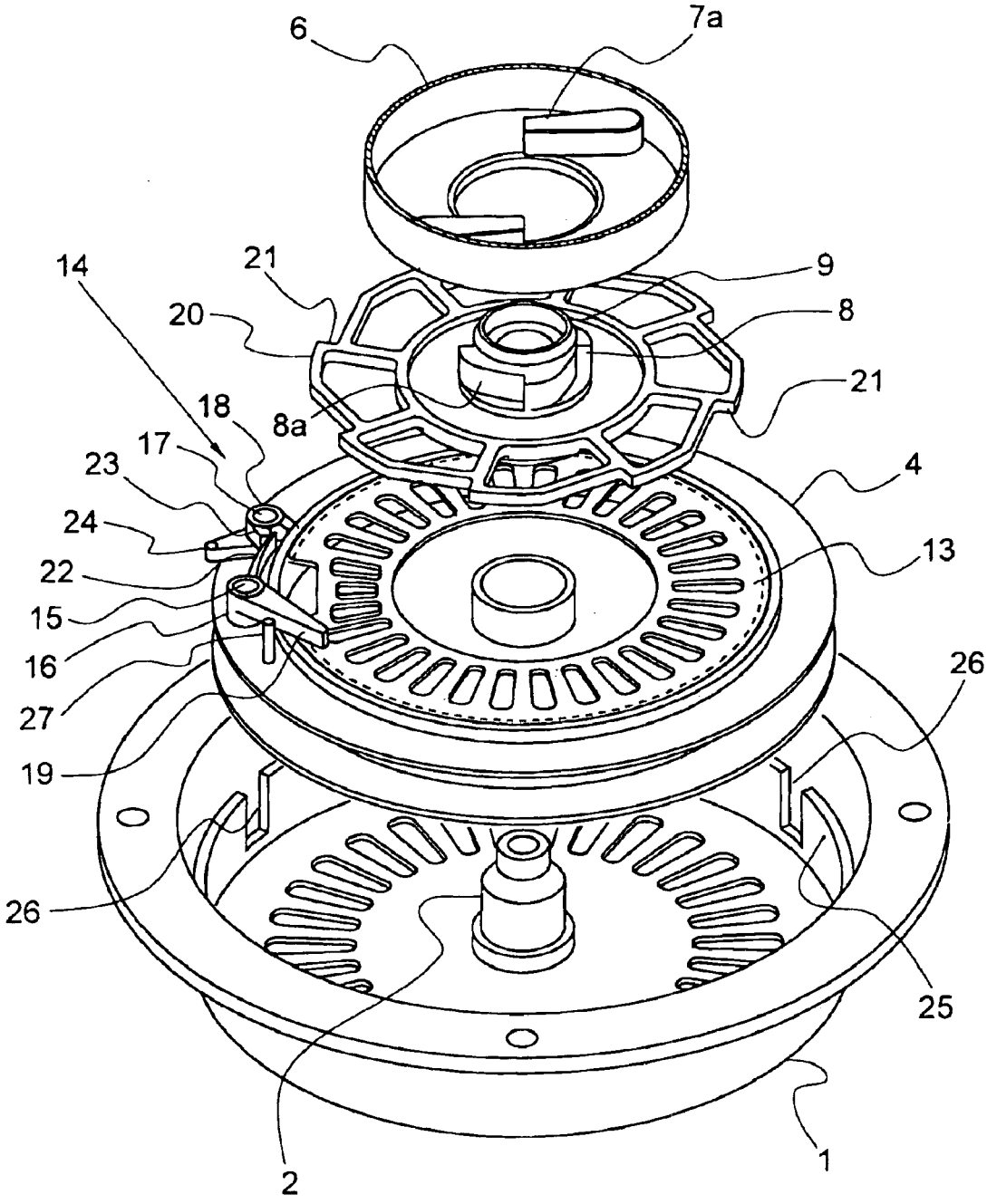
FIG. 2 is an exploded perspective view showing a configuration of major components of the recoil starter shown in FIG. 1.

Referring first to FIGS. 1 to 11, an embodiment of a recoil starter according to the present invention is illustrated. A recoil starter of the illustrated embodiment, as shown in FIGS. 1 and 2, includes a casing 1 that internally houses main components of the recoil starter and is formed to be mounted to an engine so as to cover a side surface portion of the engine. A reel shaft 2 is formed, so as to be opposite to a crankshaft (not shown) of the engine, on an inner side surface of the casing 1. A rope reel 4 around which a recoil rope 3 is wound is rotatably attached to the reel shaft 2. The recoil rope 3 that is wound around a drum portion 4*a* formed on an outer periphery of the rope reel 4 has one end thereof fixed to the rope reel 4 and the other end thereof drawn to the outside of the casing 1, so that the rope reel 4 is driven and rotated about the reel shaft 2 by pulling the other end of the recoil rope 3.

A recoil spring 5 is provided between a side surface of the rope reel 4 and an outer peripheral surface of a base portion of the reel shaft 2 formed on the inner surface of the casing 1. The recoil spring 5 is arranged so as to rewind the recoil rope 3, which has been unwound from the drum portion 4*a* of the rope reel 4 rotated in an engine starting direction by pulling the recoil rope 3, onto the rope reel 4 by rotating the rope reel 4 in the opposite direction. The recoil spring 5 is fixed to the reel shaft 2 at one end on an inner peripheral side thereof and to the rope reel 4 at the other end on an outer peripheral side thereof. When the rope reel 4 is rotated in the engine starting direction by pulling the recoil rope 3, a rotational force is accumulated in the recoil spring 5. When the recoil rope 3 is released, the rope reel 4 is rotated in the opposite direction by the rotational force accumulated in the recoil spring 5, so that the recoil rope 3 drawn to the outside of the casing 1 is rewound onto the rope reel 4.

Figure 3:
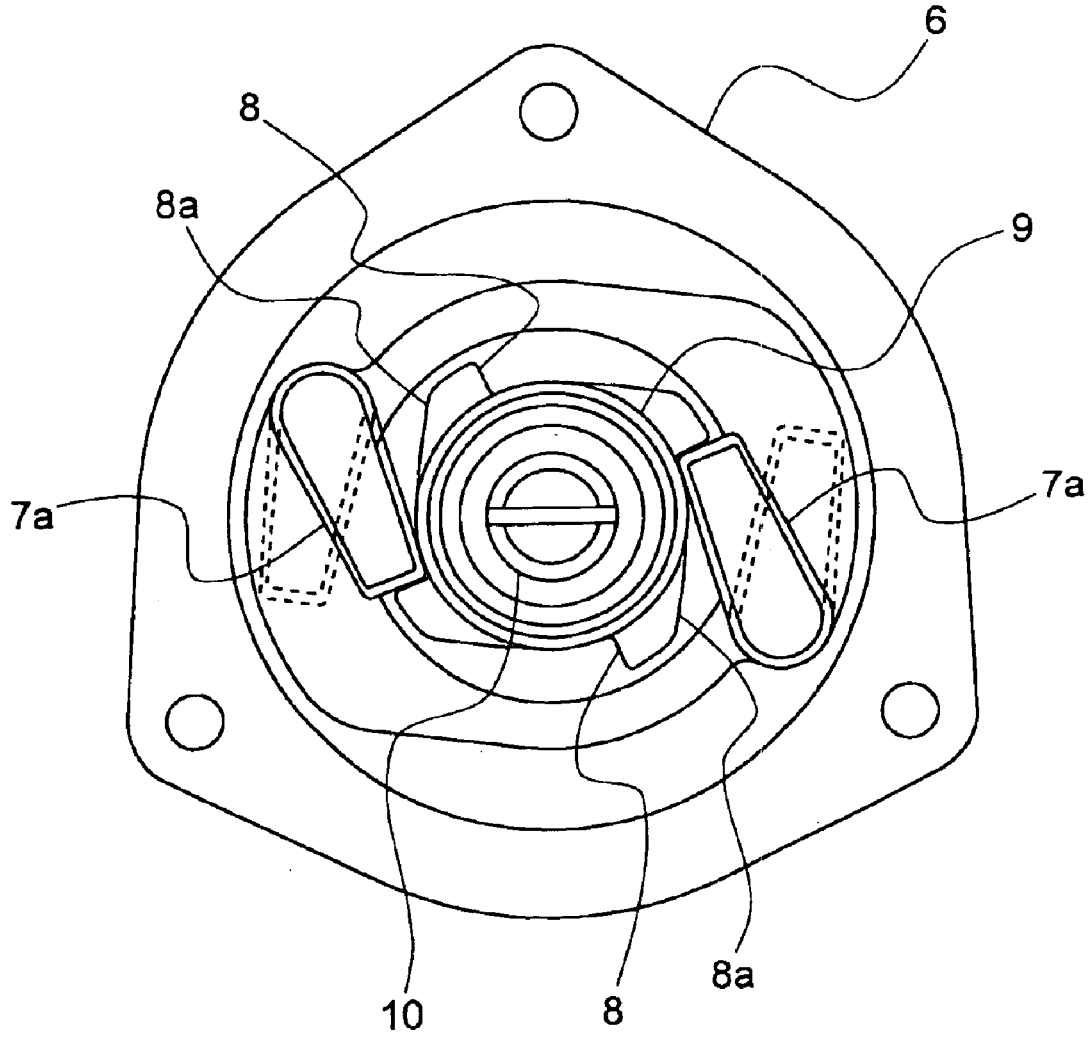
FIG. 3 is a front view showing a clutch mechanism of the recoil starter shown in FIG. 1.

A cam 9 is rotatably mounted to a distal end side of the reel shaft 2. The cam 9 has cam pieces 8 that are formed on an outer circumferential surface thereof so as to engage with a clutch mechanism 7 provided on a drive pulley 6 that is attached to the crankshaft of the engine. The cam 9 and the rope reel 4 are rotatably supported together by the reel shaft 2 with a screw 10 screwed into an end portion of the reel shaft 2. As shown in FIGS. 1 and 3, the clutch mechanism 7 provided on the drive pulley 6 is configured as a centrifugal clutch mechanism having centrifugal ratchets 7*a* that are rotationally movable and biased by respective springs (not shown) toward the cam pieces 8 formed on the cam 9. When the cam 9 is rotated in the engine starting direction, the centrifugal ratchets 7*a* engage with the respective cam pieces 8, to thereby rotate the drive pulley 6 in the engine starting direction. When the drive pulley 6 is rotated via the crankshaft after the engine is started, the centrifugal ratchets 7*a* rotationally move due to a centrifugal force against spring-biased force and disengage from the cam pieces 8, so that rotation of the engine side can be prevented from being transmitted to the recoil starter side.

As shown in FIG. 1, a recess 11 is formed on the other side surface of the rope reel 4. The recess 11 receives a force accumulating spiral spring 12 that constitutes a cushioning and force accumulating means. The force accumulating spring 12 is housed in a spring case 13, and the spring case 13 is received in the recess 11 and fixed to the rope reel 4. The force accumulating spring 12 is fixed to the spring case 13 at one end on an outer peripheral side thereof and engages with the cam 9 at the other end on an inner peripheral side thereof. Thus, the rope reel 4 and the cam 9 are coupled via the force accumulating spring 12, so that a rotation of the rope reel 4 is transmitted to the cam 9 via the force accumulating spring 12. Relative rotation takes place between the cam 9 and the rope reel 4 as the result of inhibiting the rotation of the cam 9 due to a starting resistance of the engine, so that a rotational force of the rope reel 4 is accumulated in the force accumulating spring 12.

As shown in FIGS. 1 and 2, a ratchet mechanism 14 is provided between the cam 9 and the rope reel 4 such that the ratchet mechanism 14 disengages from the cam 9 when the rope reel 4 is rotated in the engine starting direction, whereas the ratchet mechanism 14 engages with the cam 9 when the rope reel 4 is rotated in the direction opposite to the engine starting direction, to thereby rotate the cam 9 and the rope reel 4 together in the direction opposite to the engine starting direction. The ratchet mechanism 14 comprises a ratchet member 16 that is pivotally fixed on the side surface adjacent to an outer peripheral edge of the rope reel 4 by a pivot 15 so as to be rotationally movable and an operating member 18 that is pivotally fixed by a pivot 17 formed in the vicinity of the pivot 15 so as to be rotationally movable. The cam 9 and the rope reel 4 are rotated together in the opposite direction as a ratchet pawl 19 formed on the ratchet member 16 engages with any one of a plurality of engagement surfaces 21 that are formed on an outer periphery of an engagement member 20 formed so as to protrude from the outer circumferential surface of the cam 9 and that face in the engine starting direction.

Figure 4:
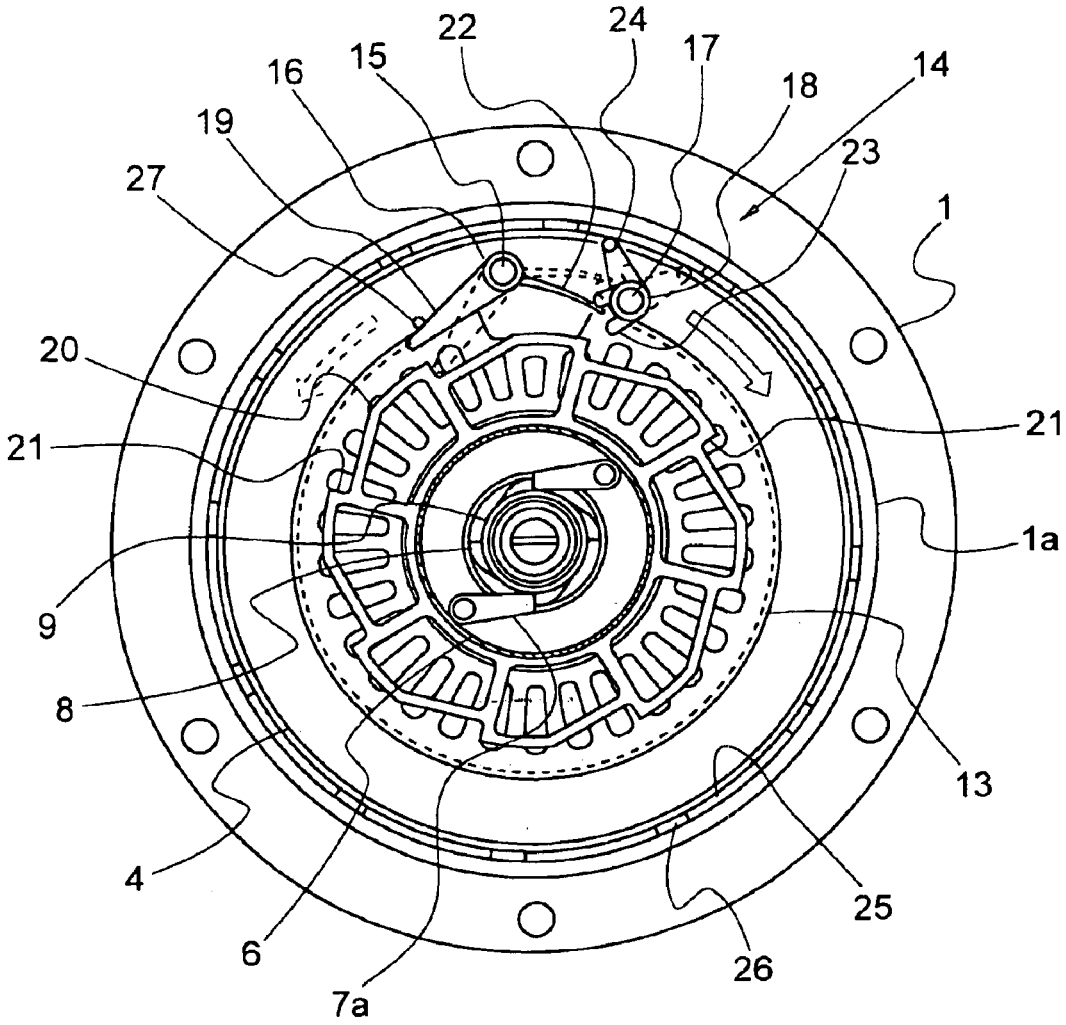
FIG. 4 is a sectional view of the recoil starter taken along line A—A of FIG. 1.
Figure 5A:
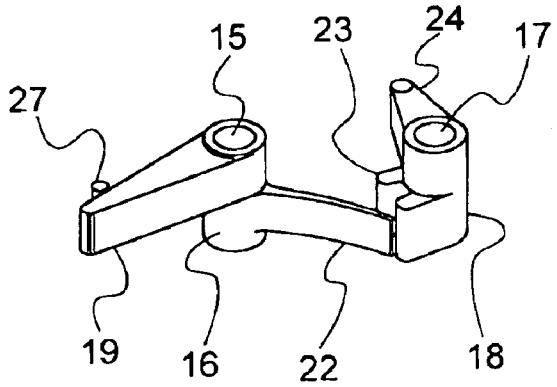
FIG. 5A is a perspective view showing a ratchet mechanism used in the recoil starter of FIG. 1 in a state where a rope reel is rotated in an engine starting direction.
Figure 5B:
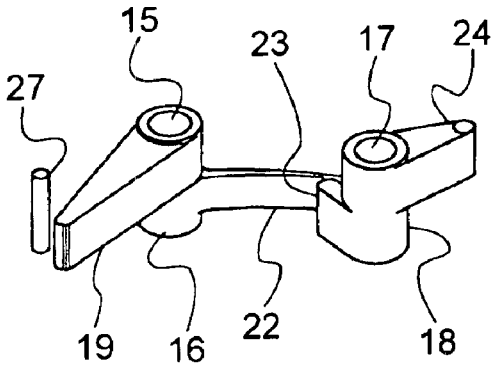
FIG. 5B is a perspective view showing the ratchet mechanism in a state where the rope reel is rotated in a direction opposite to the engine starting direction.

As shown in FIG. 5A, a spring piece 22 is integrally formed on the ratchet member 16 so as to protrude in a radial direction such that the spring piece 22 allows the ratchet pawl 19 to engage with or disengage from the engagement surfaces 21 on the engagement member 20 of the cam 9 by rotationally actuating the ratchet member 16. An actuating piece 23 and an operating piece 24 are integrally formed on the operating member 18 so as to protrude in a radial direction. The actuating piece 23 engages with the spring piece 22 to move the ratchet member 19 rotationally. The operating piece 24 operates to rotationally move the operating member 18. As shown in FIG. 4, the operating piece 24 of the operating member 18 is arranged so as to slide on an inner circumferential surface 25 of an outer wall 1*a* formed on the casing 1. The operating piece 24 is adapted to engage with each of a plurality of cutout grooves 26 formed on the inner circumferential surface 25 equidistantly in a circumferential direction so as to rotationally move the operating member 18.

When the rope reel 4 is rotated in the engine starting direction, the operating piece 24 of the operating member 18 is rotationally moved so as to be inclined backward in the rotational direction of the rope reel 4, to thereby cause the actuating piece 23 of the operating member 18 to move the spring piece 22 of the ratchet member 16 radially inward, with the result that the ratchet pawl 19 disengages from the engagement member 20 of the cam 9 as indicated by solid lines in FIG. 4 and shown in FIG. 5A. At this time, the ratchet pawl 19 comes into contact with a stopper pin 27 provided on the back side of the ratchet pawl 19, so that the rotational movement angle of the ratchet member 16 is restricted. When the rope reel 4 is rotated in the direction opposite to the engine starting direction, the operating piece 24 of the operating member 18 engages with one of the cutout grooves 26 and is rotationally moved so as to be inclined backward in the rotational direction of the rope reel 4, to thereby cause the actuating piece 23 of the operating member 18 to move the spring piece 22 of the ratchet member 16 radially outward, with the result that the ratchet pawl 19 engages with one of the engagement surfaces 21 of the engagement member 20 of the cam 9 as indicated by dashed lines in FIG. 4 and shown in FIG. 5B.

Figure 6:
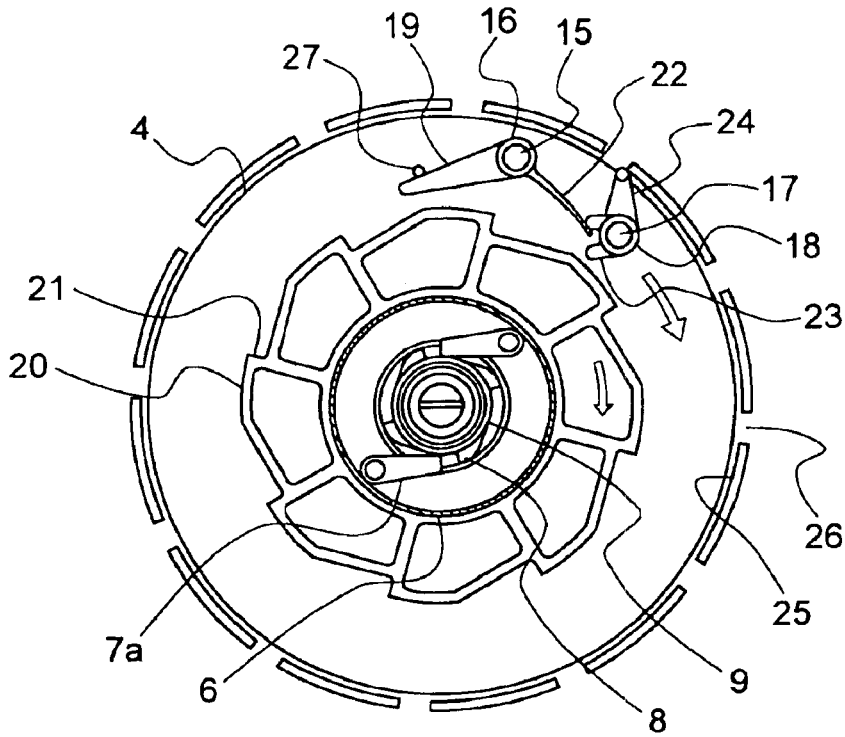
FIG. 6 is a sectional view, similar to FIG. 4, showing the state in which the ratchet member operates immediately after the rope reel is rotated in the engine starting direction.
Figure 7:
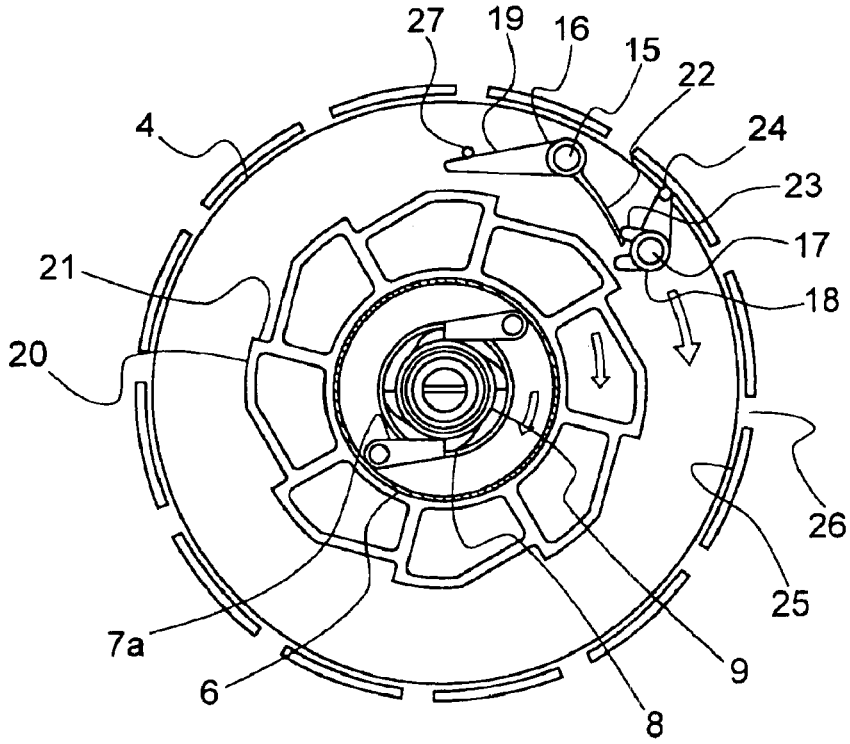
FIG. 7 is a sectional view, similar to FIG. 6, showing the state in which rotational force is transmitted to a drive pulley as the result of a cam engaging with the clutch mechanism.

The operation of the recoil starter in the illustrated embodiment will be described with reference to FIGS. 6 to 11. When the recoil rope 3 is pulled to rotate the rope reel 4 in the engine starting direction, the operating piece 24 of the operating member 18 engages with one of the cutout grooves 26 formed on the outer wall 1*a* of the casing 1, whereby the operating piece 24 is inclined backward in the rotational direction, causing the actuating piece 23 of the operating member 18 to move the spring piece 22 of the ratchet member radially inward, resulting in the ratchet pawl 19 disengaging from the engagement member 20 of the cam 9 as shown in FIG. 6. As the rope reel 4 is rotated, the cam 9 is rotated via the force accumulating spring 12, engaging the cam pieces 8 of the cam 9 with the centrifugal ratchets 7*a*, to thereby rotate the drive pulley 6, so that the crankshaft of the engine coupled to the drive pulley 6 is rotated as shown in FIG. 7.

Figure 8:
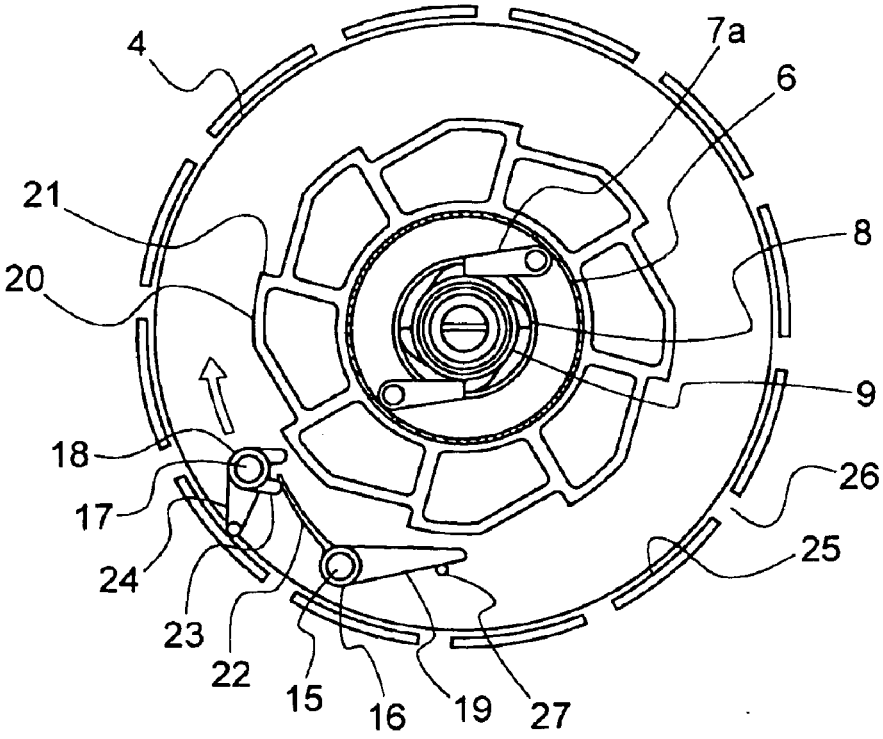
FIG. 8 is a sectional view, similar to FIG. 7, showing the state in which rotational force is accumulated in a cushioning and force accumulating means due to a rotation of the rope reel after the cam is inhibited from rotating by a starting resistance of the engine.

When the rotational load of the drive pulley 6 becomes large due to the starting resistance of the engine, the drive pulley 6 is inhibited from rotating, so that the rotation of the cam 9 of which the cam pieces 8 are engaged with the centrifugal ratchets 7*a* is prevented. However, although the cam 9 is prevented from rotating, the rope reel 4 is further rotated as shown in FIG. 8, and the force accumulating spring 12 is wound to accumulate a rotational force of the rope reel 4 in the force accumulating spring 12. Shock caused by abrupt load fluctuations on the engine side is cushioned by the force accumulating spring 12. In this process, the operating piece 24 of the operating member 18 is rotated together with the rope reel 4 while sliding on the inner circumferential surface 25 of the outer wall 1*a* of the casing 1, whereas the ratchet pawl 19 of the ratchet member 16 is kept in contact with the stopper pin 27 and disengaged from the engagement member 20 of the cam 9 via the spring piece 22 engaging with the actuating piece 23 of the operating member 18.

Figure 9:
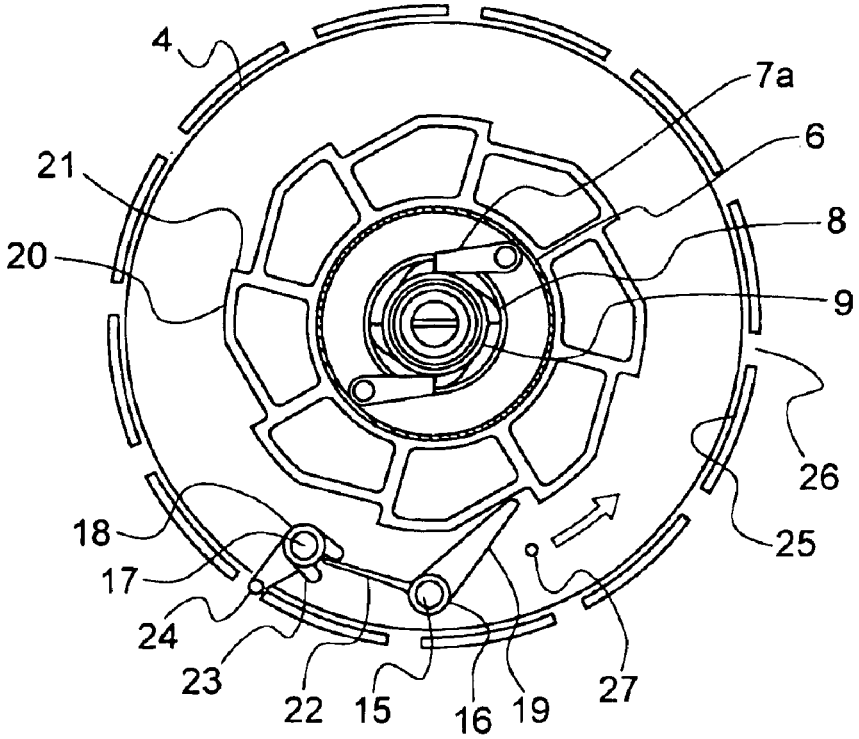
FIG. 9 is a sectional view, similar to FIG. 4, showing the state in which the ratchet mechanism operates immediately after the rope reel is rotated in the opposite direction.
Figure 10:
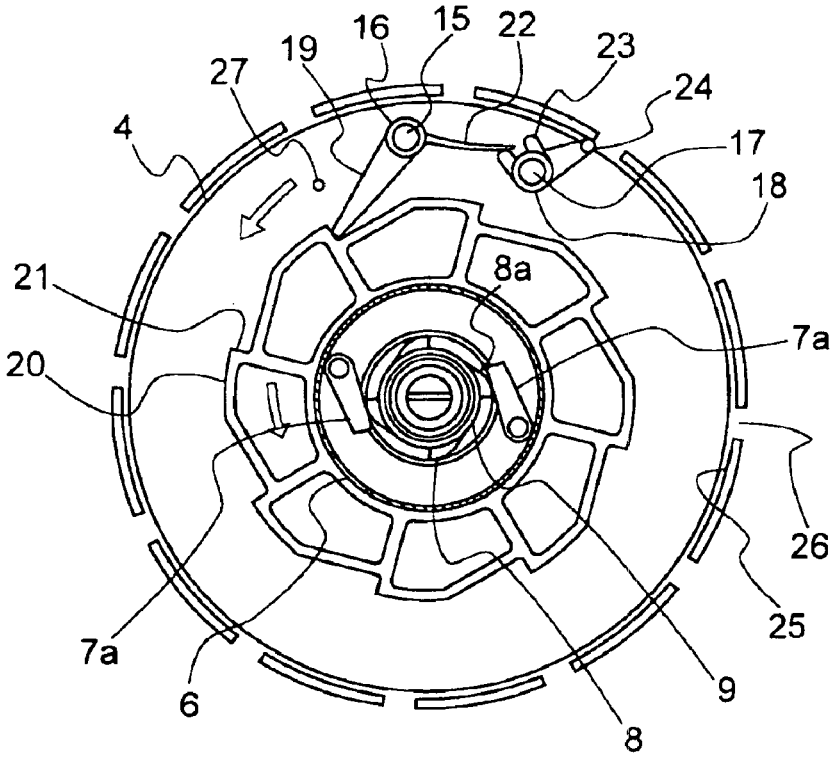
FIG. 10 is a sectional view, similar to FIG. 4, showing the state in which the rope reel and the cam are rotated together in the opposite direction by the ratchet member.

When the recoil rope 3 being pulled is released under this condition, the rope reel 4 is rotated in the direction opposite to the engine starting direction due to the rotational force accumulated in the recoil spring 5, resulting in the recoil rope 3 being rewound onto the rope reel 4. When the rope reel 4 is rotated in the opposite direction as shown in FIG. 9, the operating piece 24 of the operating member 18 engages with one of the cutout grooves 26 formed on the outer wall 1*a* of the casing 1, so that the operating piece 24 is inclined backward in the rotational direction of the rope reel 4, whereby the ratchet member 16 is pivotally turned counterclockwise through rotating of the operating member 18 to engage the ratchet pawl 19 with one of the engagement surfaces 21 of the engagement member 20 of the cam 9, with the result that the cam 9 and the rope reel 4 are rotated together in the opposite direction. This allows the force accumulating spring 12 to rotate together with the rope reel 4 and the cam 9 in the opposite direction, with the rotational force accumulated in the force accumulating spring 12. As shown in FIG. 10, the centrifugal clutch 7 engaging with the cam 9 permits rotation of the cam 9 in the opposite direction due to sloping surfaces 8*a* formed on the back sides of the cam pieces 8. Thus, it is possible to rewind the recoil rope 3 onto the rope reel 4 while maintaining the rotational force accumulated in the force accumulating spring 12.

Figure 11:
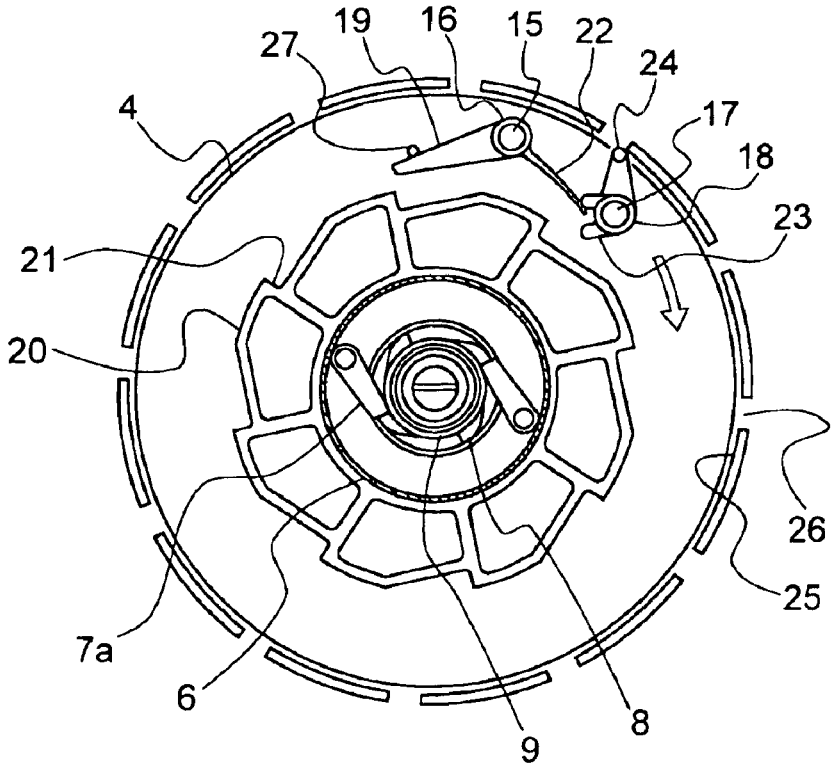
FIG. 11 is a sectional view, similar to FIG. 10, showing the state in which the ratchet mechanism uncouples the rope reel from the cam as the result of the rope reel being rotated again in the engine starting direction.
Figure 12:
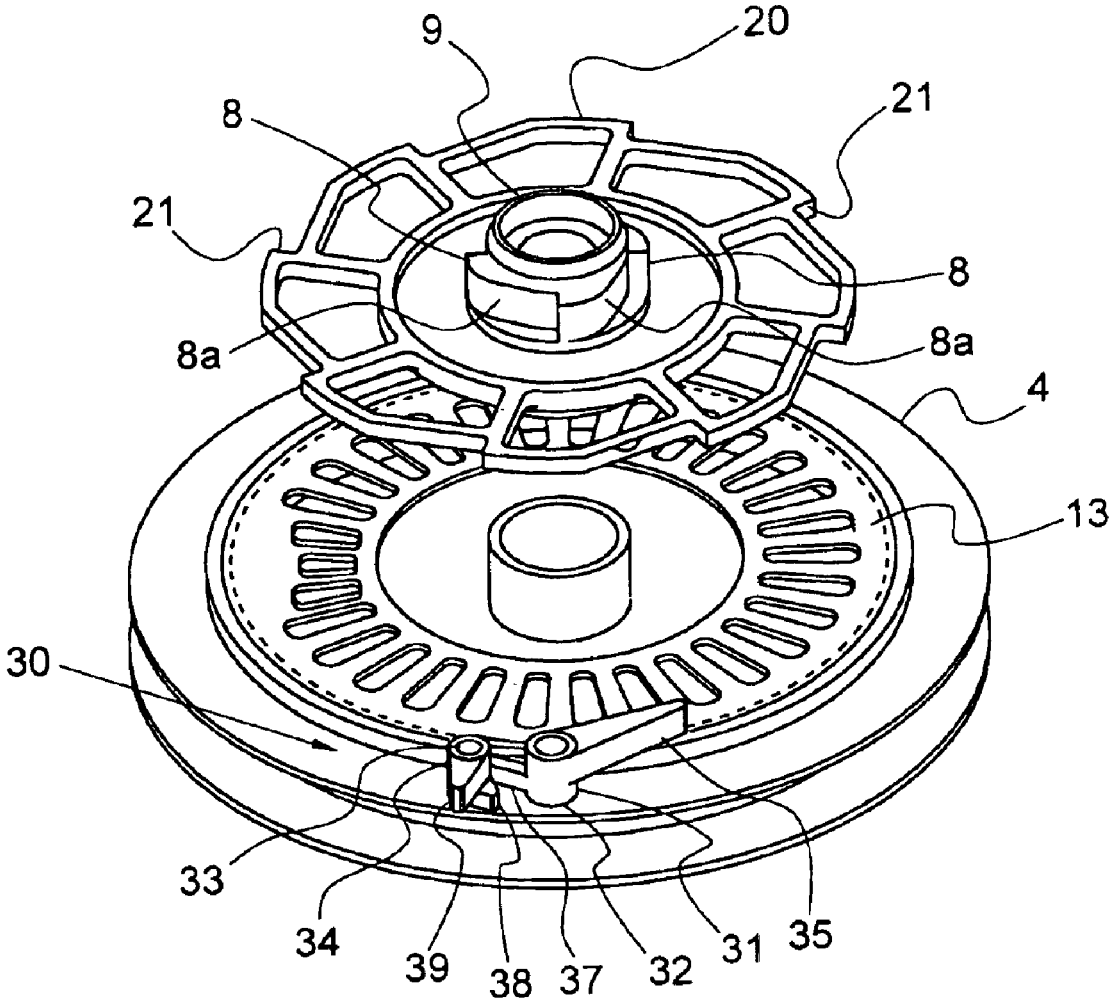
FIG. 12 is a perspective view showing a ratchet mechanism in accordance with another embodiment of the present invention.

When the rope reel 4 is rotated again in the engine starting direction by pulling the recoil rope 3, the cam 9 is rotated via the force accumulating spring 12 having the rotational force accumulated therein, so that the cam pieces 8 of the cam 9 engage with the centrifugal ratchets 7*a*, to thereby transmit the starting resistance of the engine to the cam 9 again, resulting in the cam 9 being inhibited from rotating as shown in FIG. 11. As the result of the rotation of the rope reel 4, the operating piece 24 of the operating member 18 engages with one of the cutout grooves 26, rotationally moving the operating member 18 so as to be inclined backward in the rotational direction, to thereby cause the actuating piece 23 to rotationally move the spring piece 22 of the ratchet member 16, resulting in the ratchet pawl 19 being disengaged from the engagement member 20 of the cam 9. As the rope reel 4 is further rotated by pulling the recoil rope 3, the rotational force is further accumulated in the force accumulating spring 12. When the rotational force accumulated in the force accumulating spring 12 exceeds the starting resistance of the engine, the rotational force of the rope reel 4 and that accumulated in the force accumulating spring 12 are released, so that the resultant rotational force is transmitted to the drive pulley 6 via the cam 9, abruptly rotating the crankshaft to start the engine.

Referring now to FIGS. 12 to 14B, another embodiment of a recoil starter according to the present invention is illustrated. In a recoil starter of the illustrated embodiment, a ratchet mechanism 30 provided between the rope reel 4 and the cam 9 comprises a ratchet member 32 pivotally mounted to a pivot 31 formed on the side surface of the outer peripheral portion of the rope reel 4 and an operating member 34 pivotally fixed to a pivot 33 formed in the vicinity of the pivot 31. A ratchet pawl 35 integrally formed on the ratchet member 32 engages with one of the engagement surfaces 21 of the engagement member 20 formed on the outer periphery of the cam 9, so that the cam 9 and the rope reel 4 are rotated together in the direction opposite to the engine starting direction.

The ratchet member 32 is rotationally biased by a spring 36 in a direction in which the ratchet pawl 35 of the ratchet member 32 is brought into contact with the engagement member 20 of the cam 9. Further, an operating piece 37 is integrally formed on the ratchet member 32 so as to operate the ratchet member 32 to be pivotally turned. An actuating piece 38 and an operating piece 39 are integrally formed on the operating member 34 such that the actuating piece 38 rotates the ratchet member 32 by engaging with the operating piece 37 while the operating piece 39 slides on the inner circumferential surface 25 of the outer wall 1*a* of the casing 1. Other configuration is the same as that in the aforementioned embodiment.

Figure 13:
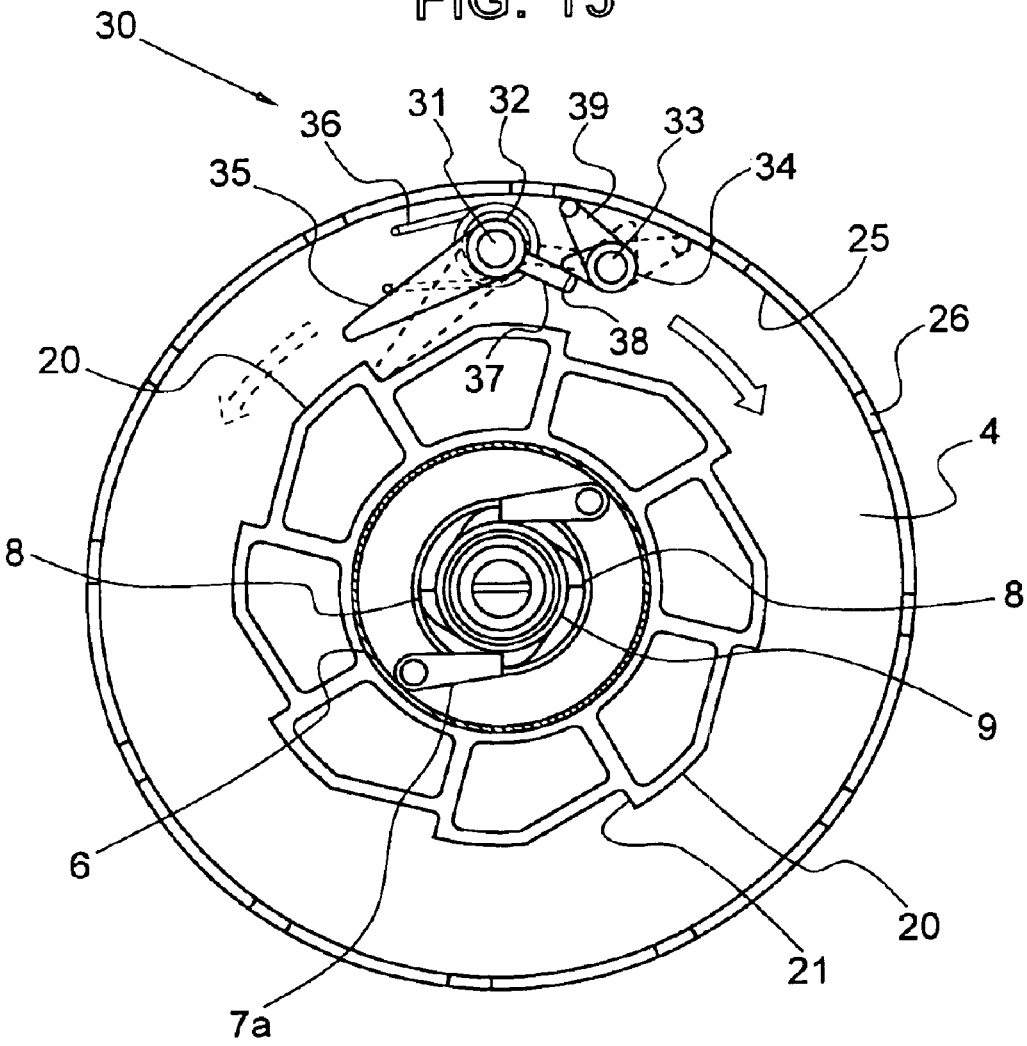
FIG. 13 is a front view showing the ratchet mechanism shown in FIG. 12.
Figure 14A:
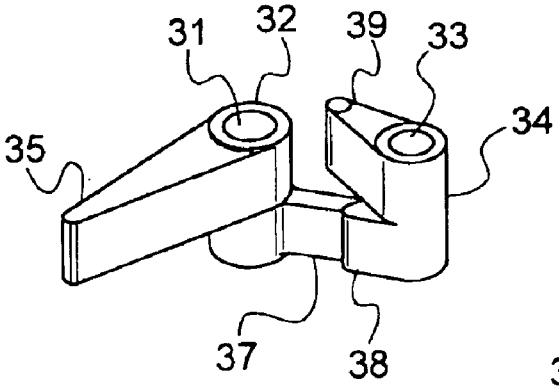
FIG. 14A is a perspective view showing the ratchet mechanism of FIG. 12 in a state where a rope reel is rotated in the engine starting direction.
Figure 14B:
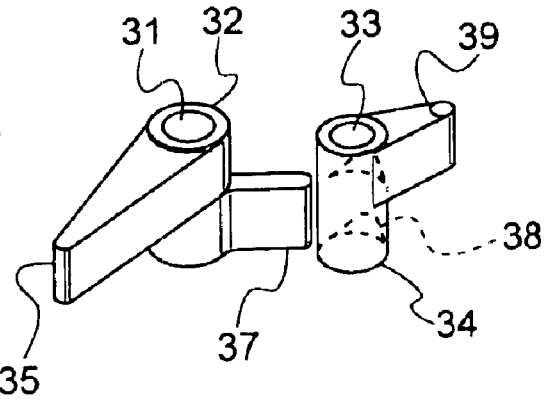
FIG. 14B is a perspective view showing the ratchet mechanism in a state where the rope reel is rotated in the direction opposite to the engine starting direction.
Figure 15:
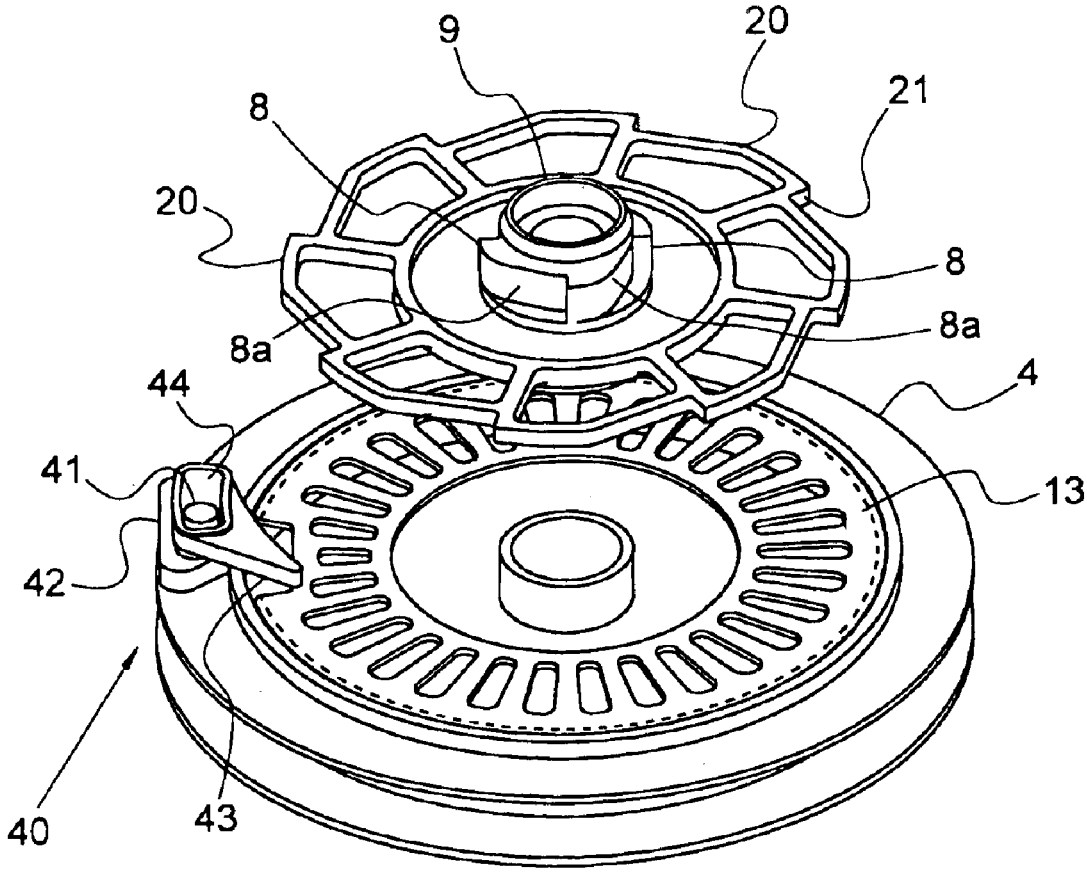
FIG. 15 is a perspective view showing a ratchet mechanism in accordance with still another embodiment of the present invention.

In the recoil starter thus constructed, when the rope reel 4 is rotated in the engine starting direction, the operating piece 39 engages with one of the cutout grooves 26 formed on the outer wall 1*a*, whereby the operating piece 39 is inclined backward in the rotational direction of the rope reel 4 to pivotally turn the operating member 34, causing the actuating piece 38 of the operating member 34 to engage with the operating piece 37 of the ratchet member 32 and pivotally turn the ratchet member 32 in a direction in which the ratchet pawl 35 is disengaged from the engagement member 20 of the cam 9 as indicated by solid lines in FIG. 13 and shown in FIG. 14A. When the rope reel 4 is rotated in the direction opposite to the engine starting direction, the operating piece 39 engages with one of the cutout grooves 26 formed on the outer wall 1*a*, pivotally moving the operating member 34, whereby the actuating piece 38 of the operating member 34 is disengaged from the operating piece 37 of the ratchet member 32, so that the ratchet member 32 is pivotally turned by a biased force of the spring 36 in a direction in which the ratchet pawl 35 engages with the engagement member 20 of the cam 9, with the result that the cam 9 and the rope reel 4 are rotated together in the opposite direction as indicated by dashed lines in FIG. 13 and shown in FIG. 14B.

Referring now to FIGS. 15 to 17B, a further embodiment of a recoil starter according to the present invention is illustrated. In a recoil starter of the illustrated embodiment, a ratchet mechanism 40 provided between the rope reel 4 and the cam 9 comprises a ratchet member 42 swingably supported by a pivot 41 that is formed on the side surface of the outer peripheral portion of the rope reel 4. A ratchet pawl 43 formed on the ratchet member 42 engages with one of the engagement surfaces 21 of the engagement member 20 formed on the outer periphery of the cam 9, so that the cam 9 and the rope reel 4 are rotated together in the direction opposite to the engine starting direction.

Figure 17A:
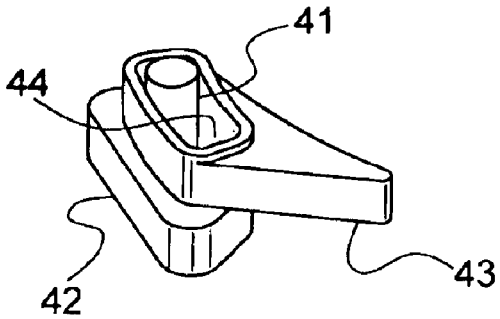
FIG. 17A is a perspective view showing the ratchet mechanism of FIG. 15 in a state where a rope reel is rotated in the engine starting direction.
Figure 17B:
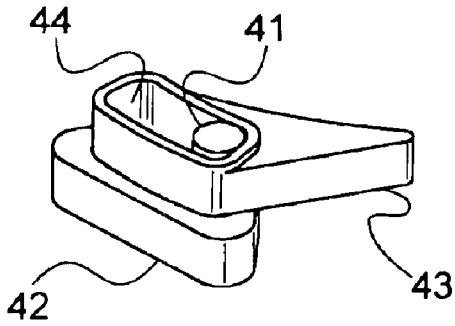
FIG. 17B is a perspective view showing the ratchet mechanism in a state where the rope reel is rotated in the direction opposite to the engine starting direction.
Figure 18:
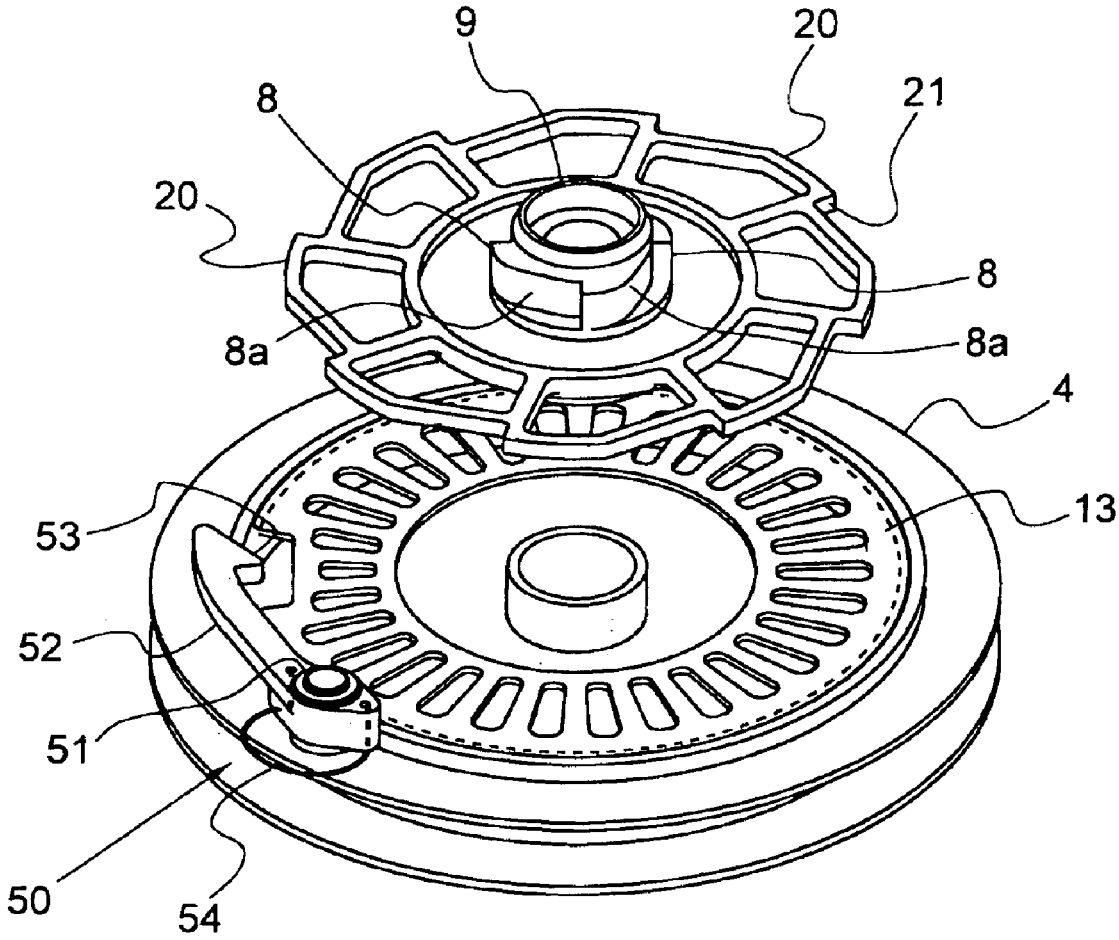
FIG. 18 is a perspective view showing a ratchet mechanism in accordance with a further embodiment of the present invention.

As shown in FIG. 17A, an elongated opening 44 is formed in the ratchet member 42. The pivot 41 is loosely fit into the opening 44 to support the ratchet member 42 such that the ratchet member 42 can move along the circumference of the rope reel 4 within the opening 44 and rotationally move about the pivot 41. Further, opposite end portions of the inner side of the ratchet member 42 along the circumference are pressed and biased toward the inner circumferential surface 25 of the outer wall 1*a* of the casing 1 by a leaf spring 45 that constitutes a biasing means. The pressing force of the leaf spring 45 allows one of the outer end edges of the ratchet member 42 along the circumference to come into contact with and slide on the inner circumferential surface 25 of the outer wall 1*a*. Other configuration is the same as that in the aforementioned embodiments.

Figure 16:
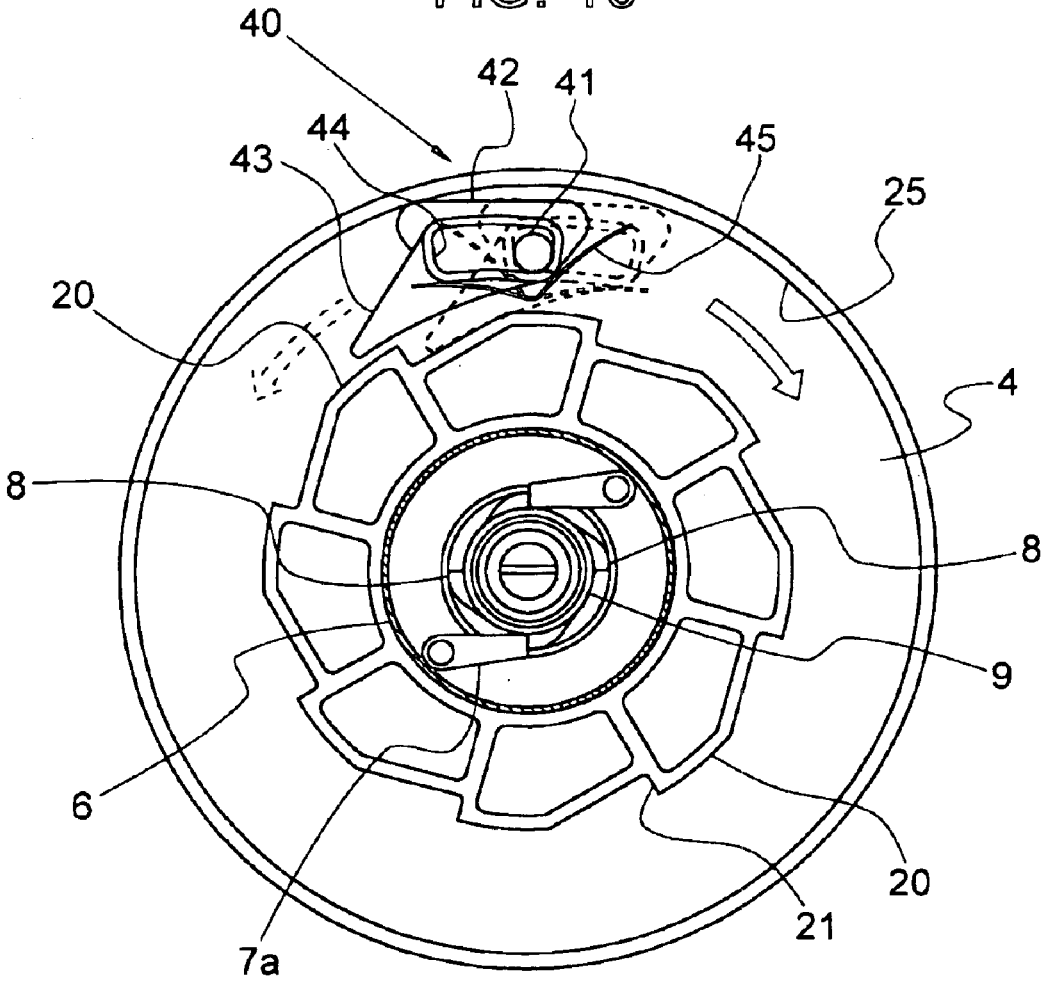
FIG. 16 is a front view showing the ratchet mechanism shown in FIG. 15.

In the illustrated embodiment thus constructed, when the rope reel 4 is rotated in the engine starting direction, the ratchet member 42 is moved backward in the rotational direction of the rope reel 4 due to a frictional resistance acting on the outer end edge of the ratchet member 42 which is in contact with the inner circumferential surface 25 of the outer wall 1*a* and the ratchet pawl 43 is swung in a direction in which the ratchet pawl 43 is disengaged from the engagement member 20 of the cam 9 due to pressing action of the leaf spring 45 as indicated by solid lines in FIG. 16 and shown in FIG. 17A. When the rope reel 4 is rotated in the direction opposite to the engine starting direction, the ratchet member 42 is moved backward in the rotational direction due to the frictional resistance acting on the outer end edge of the ratchet member 42 which is in contact with the inner circumferential surface 25 of the outer wall 1*a* and the ratchet pawl 43 is swung in a direction in which the ratchet pawl 43 is engaged with the engagement member 20 of the cam 9 due to pressing action of the leaf spring 45 as indicated by dashed lines in FIG. 16 and shown in FIG. 17B, resulting in the cam 9 and the rope reel 4 being rotated together in the opposite direction.

Referring now to FIGS. 18 to 20B, still another embodiment of a recoil starter according to the present invention is illustrated. In a recoil starter of the illustrated embodiment, a ratchet mechanism 50 provided between the rope reel 4 and the cam 9 comprises a ratchet member 52 pivotally supported by a pivot 51 that is formed on the side surface of the outer peripheral portion of the rope reel 4. A ratchet pawl 53 formed at a distal end of the ratchet member 52 engages with one of the engagement surfaces 21 of the engagement member 20 formed on the outer periphery of the cam 9, so that the cam 9 and the rope reel 4 are rotated together in the direction opposite to the engine starting direction.

The ratchet mechanism 50 is further provided with a biasing spring piece 54 that is formed by curving a linear elastic material in the form of a circular arc. The biasing spring piece 54 is supported on the ratchet member 52 while opposite end portions 54*b* and 54*c* thereof, which are formed by bending them vertically from the opposite ends of a curved portion 54*a* thereof, are respectively inserted in holes 52*a* and 52*a* formed in the ratchet member 52 on the opposite sides of the pivot 51. The back side of the curved portion 54*a* of the biasing spring piece 54 is pressed against the inner circumferential surface 25 of the outer wall 1*a* of the casing 1 so as to slide on the inner circumferential surface 25. When the curved portion 54*a* of the biasing spring piece 54 is deformed due to a sliding resistance between the curved portion 54*a* and the inner circumferential surface 25 of the outer wall 1*a*, the ratchet member 52 is rotated about the pivot 51 by the end portions 54*b* and 54*c*.

Figure 19:
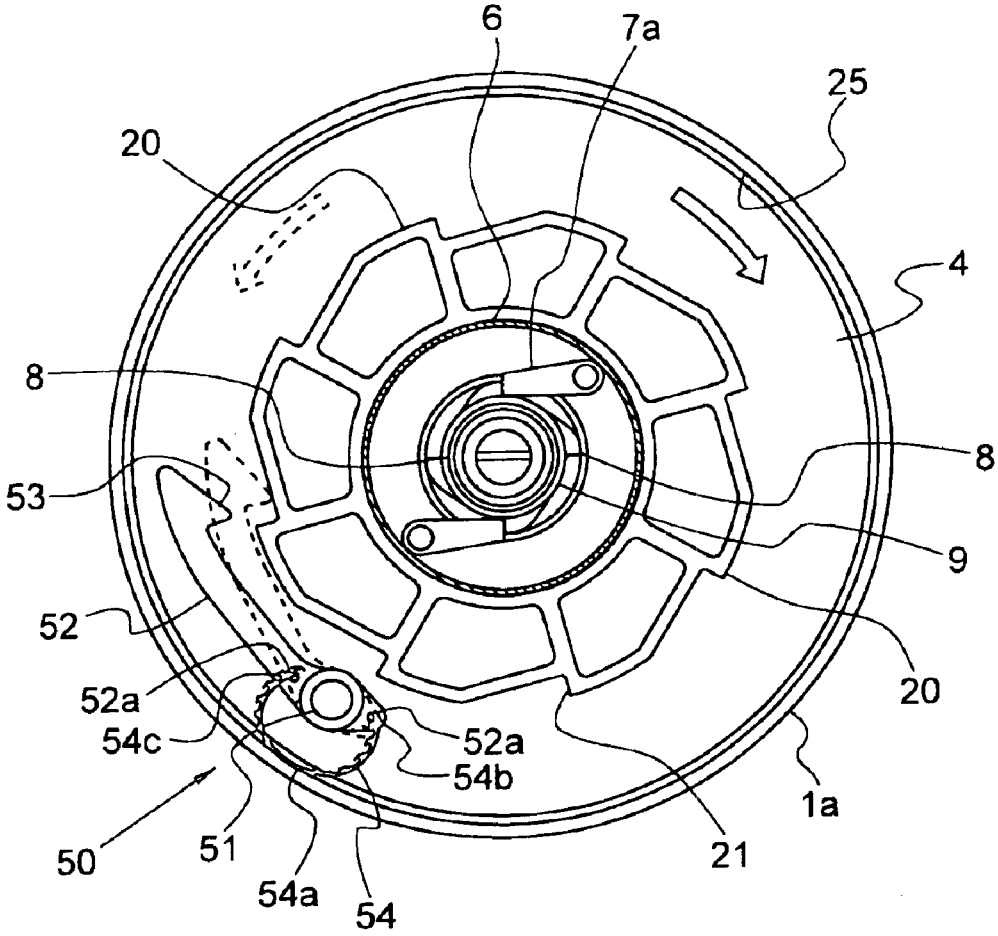
FIG. 19 is a front view showing the ratchet mechanism shown in FIG. 18.
Figure 20A:
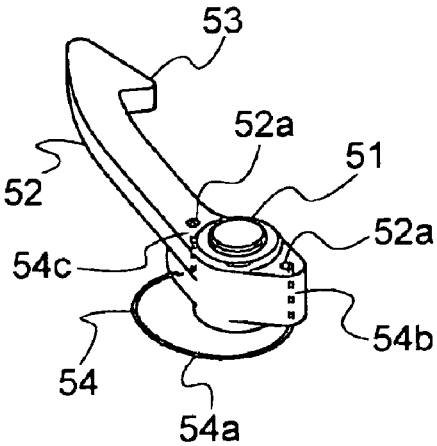
FIG. 20A is a perspective view showing the ratchet mechanism of FIG. 18 in a state where a rope reel is rotated in the engine starting direction.
Figure 20B:
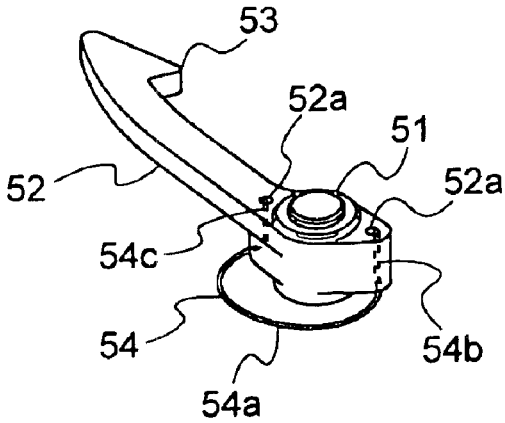
FIG. 20B is a perspective view showing the ratchet mechanism in a state where the rope reel is rotated in the direction opposite to the engine starting direction.

More specifically, when the recoil rope 4 is rotated in the engine starting direction shown by the arrow indicated by solid lines in FIG. 19 by pulling the recoil rope 3, the curved portion 54*a* of the biasing spring piece 54 that rotates together with the rope reel 4 is slid on the inner circumferential surface 25 of the casing 1, whereby the curved portion 54*a* is deformed backward in the rotational direction of the rope reel 4 due to the sliding resistance and the end portion 54*b* is displaced radially inward while the end portion 54*c* is displaced radially outward. This allows the ratchet member 52 to rotate about the pivot 51, resulting in the ratchet pawl 53 being disengaged from the engagement member 20 of the cam 9. When the recoil rope 4 is rotated in a direction in which the recoil rope 3 is rewound as shown by the arrow indicated by dashed lines in FIG. 19, the end portion 54*b* of the biasing spring piece 54 is displaced radially outward while the end portion 54*c* thereof is displaced radially inward, whereby the ratchet member 52 is pivotally rotated so as to make the ratchet pawl 53 engage with one of the engagement surfaces 21 of the engagement member 20 of the cam 9, resulting in the cam 9 and the rope reel 4 being rotated together. Other configuration is the same as that in the aforementioned embodiments.

In the illustrated embodiment, the biasing spring piece 54 is formed of a linear elastic material. Alternatively, the biasing spring piece may be formed from an elastic piece in the form of a thin plate by curving it and holding opposite end portions of the elastic piece onto the ratchet member 52 on the opposite sides of the rotational axis of the pivot 51 such that the same action can be performed as that in the illustrated embodiment.

Figure 21:
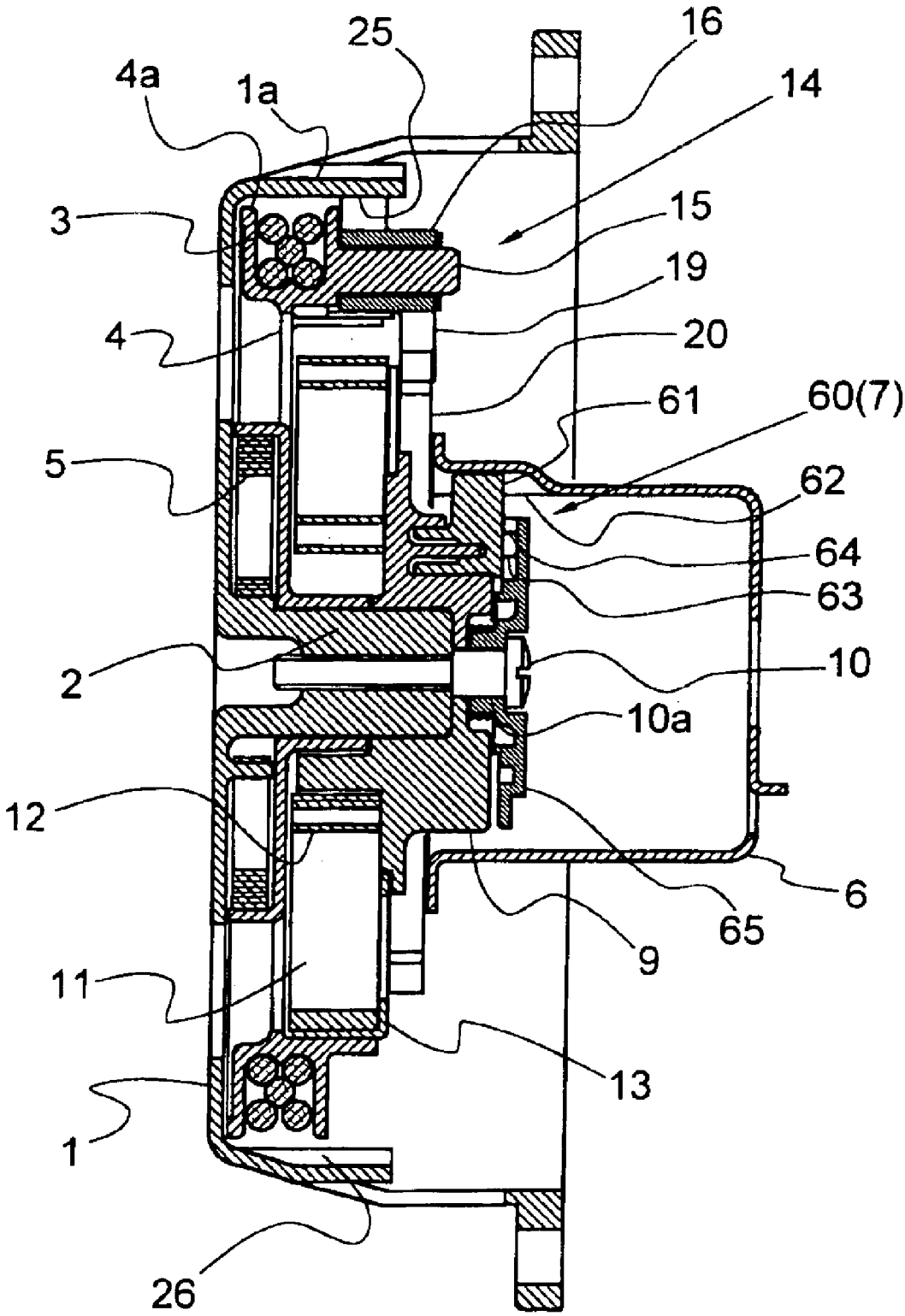
FIG. 21 is a sectional side elevation view showing a clutch mechanism according to a still further embodiment of the present invention.

Referring now to FIG. 21, a still further embodiment of a recoil starter according to the present invention is illustrated. In the embodiments described above, the clutch mechanism 7 is so constructed that the clutch mechanism 7 is operated by a centrifugal force produced by the rotation of the drive pulley 6 and is designed to transmit the rotation of the cam 9 to the engine side through the centrifugal ratchets 7*a* that are provided on the drive pulley 6 coupled to the crankshaft of the engine so as to engage with the cam pieces 8 formed on the cam 9. In the embodiment shown in FIG. 21, the clutch mechanism 7 comprises a one-way clutch 60 constructed to transmit a rotation of the cam 9 via a ratchet 61 provided on the cam 9 to the engine side. The ratchet 61 is pivotally arranged on the cam 9 so as to be engaged with and disengaged from an engagement portion 62 formed on an inner peripheral surface of the drive pulley 6 that is coupled to the engine. Other configuration is the same as that in the aforementioned embodiments.

In the one-way clutch 60, the ratchet 61 having a protrusion 63 formed on the top surface thereof is held at one end thereof on the cam 9 so as to be rotatable. A ratchet guide 65, which has a guide groove 64 formed on a surface thereof opposite to the ratchet 61, is mounted to the reel shaft 2 so as to be rotatable. The ratchet guide 65 is elastically fitted around a cylindrical portion 10*a* of a screw 10 that is screwed into the reel shaft 2, so that a predetermined rotational resistance is applied to the ratchet guide 65 relative to the screw 10. The protrusion 63 of the ratchet 61 is loosely fitted into the guide groove 64 of the ratchet guide 65. When the cam 9 is rotated, the ratchet 61 is rotated together with the cam 9, so that the protrusion 63 of the ratchet 61 engages with the guide groove 64 of the ratchet guide 65 to which the rotational resistance is applied, whereby the ratchet 61 is rotated about the one end to cause a distal end portion of the ratchet 61 to outwardly project and engage with the engagement portion 62 of the drive pulley 6, resulting in a rotation of the cam 9 in the engine starting direction being transmitted to the drive pulley 6. When the cam 9 rotates in the opposite direction, the protrusion 63 of the ratchet 61 engages with the guide groove 64, to thereby retract the distal end portion of the ratchet 61 radially inward, resulting in the transmission of rotation being inhibited.

The recoil starter in each of the above described embodiments enables to readily start the engine without transmission of shock to the recoil rope 3 due to a cushioning and force accumulating action of the force accumulating spring 12 by pulling the recoil rope 3 a relatively long distance. Also, a rotational force can be accumulated in the force accumulating spring 12 by pulling the recoil rope 3 a short distance several times. Therefore, the position at which force is applied to the recoil rope 3 can be adjusted, to thereby facilitate, in association with the cushioning action, starting the engine with a lesser shock.

According to the present invention, starting of the engine can be carried out while shock is absorbed through the cushioning and force accumulating action by pulling the recoil rope a relatively long distance. Starting of the engine can also be carried out while shock is more effectively absorbed through the cushioning and force accumulating action by pulling the recoil rope a short distance several times. Therefore, the distance which the recoil rope is pulled and the position at which force is applied to the recoil rope can be adjusted, to thereby enable, in association with the cushioning action, to easily start the engine with a lesser shock.

In addition, according to the present invention, the ratchet mechanism is provided between the rope reel and the cam such that the ratchet mechanism is disengaged from the cam when the rope reel is rotated in the engine starting direction and the ratchet mechanism is engaged with the cam when the rope reel is rotated in the opposite direction, so that the cam and the rope reel rotate together. Such construction requires neither a rotating member such as a spring case that rotates independently nor a one-way clutch mechanism that permits rotation of the rotating member only in one direction between the rope reel and the cam, unlike the prior art, resulting in a reduction in the manufacturing costs of the recoil starter and a reduction in size and weight thereof being achieved.

In one embodiment of the present invention, the clutch mechanism provided between the drive pulley and the cam comprises the centrifugal clutch disposed on the drive pulley and provided with the centrifugal ratchets. Therefore, when the crankshaft rotates as the result of the engine being started, the drive pulley holding thereon the centrifugal ratchets is rotated by the engine, so that the centrifugal ratchets are disengaged from the cam due to a centrifugal force, whereby rotation on the engine side is prevented from being transmitted to the cam and the rope reel side.

Moreover, in one embodiment of the present invention, the clutch mechanism provided between the drive pulley and the cam comprises the one-way clutch that includes the ratchet provided on the cam so as to engage with or disengage from the engagement portion formed on the drive pulley. Therefore, when the cam is rotated in the engine starting direction by pulling the recoil rope, transmission of rotation is reliably performed; and when the cam is rotated in the opposite direction and after the engine is started, transmission of rotation between the drive pulley and the cam is positively inhibited, whereby rotation on the engine side is prevented from being transmitted to the cam and the rope reel side.

Additionally, in one embodiment of the present invention, the cushioning and force accumulating means comprises the spiral spring that has one end thereof held on the rope reel and the other end thereof held on the cam, so that the cushioning capability can be set to be high, allowing the engine to be smoothly started with high cushioning effect. The force accumulating capability can also be set to be high, so that a rotational force required to start the engine can be sufficiently accumulated.

Furthermore, in one embodiment of the present invention, the ratchet mechanism provided between the rope reel and the cam comprises the ratchet member pivotally supported on the side surface of the outer peripheral portion of the rope reel and the operating member that operates the ratchet member to rotate it, wherein the operating piece is formed on the operating member so as to pivotally rotate the operating member by engaging with one of the cutout grooves formed on the inner circumference surface of the outer wall of the casing. Such construction allows the ratchet pawl of the ratchet member to reliably engage with or disengage from the engagement member of the cam when the rope reel is rotated in the engine starting direction or in the opposite direction, resulting in a stable operation being performed.

Moreover, in one embodiment of the present invention, the ratchet mechanism comprises the ratchet member swingably supported on the side surface of the outer peripheral portion of the rope reel, and the ratchet member is biased by the biasing means so as to come into contact with and slide on the inner circumferential surface of the outer wall of the casing. Such construction allows the ratchet pawl of the ratchet member to reliably engage with or disengage from the engagement member of the cam in a stable manner depending on the rotational direction of the rope reel as in the aforementioned embodiment.

Additionally, in one embodiment of the present invention, the ratchet mechanism comprises the ratchet member pivotally supported on the side surface of the rope reel and provided at one end thereof with the ratchet pawl engageable with the engagement member formed on the outer periphery of the cam and the biasing spring piece having a curved shape and supported at the opposites ends thereof on the ratchet member while the curved portion of the biasing spring piece is kept in sliding contact with the inner circumferential surface of the outer wall of the casing, so that the biasing spring piece is deformed due to the sliding resistance between the curved portion and the inner circumferential surface, whereby the opposite ends of the biasing spring piece pivotally rotate the ratchet member about the pivot. Such construction allows the ratchet pawl of the ratchet member to reliably engage with or disengage from the engagement member of the cam in a stable manner depending on the rotational direction of the rope reel as in the embodiments mentioned above.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A recoil starter, comprising:

a casing having a reel shaft formed therein and adapted to be mounted to an engine;

a rope reel rotatably supported on said reel shaft and provided on an outer periphery thereof with a drum portion around which a recoil rope is wound;

a recoil spring for rotationally urging said rope reel in a direction in which said recoil rope is rewound;

a cam engageable, via a clutch mechanism, with a drive pulley coupled to the engine, for transmitting a rotation thereof to said drive pulley;

a cushioning and force accumulating means interposed between said rope reel and said cam, a rotational force of said rope reel accumulated in said cushioning and force accumulating means being transmitted via said cam to said drive pulley, to thereby start the engine; and a ratchet mechanism is provided between said rope reel and said cam such that, when said rope reel is rotated in an engine starting direction, said ratchet mechanism uncouples said rope reel and said cam from each other, and when said rope reel is rotated in the direction opposite to the engine starting direction by the rotational force accumulated in said recoil spring, said ratchet mechanism couples said rope reel and said cam to each other so that said cam is rotated together with said rope reel in said opposite direction.

2. The recoil starter according to claim 1, wherein said clutch mechanism comprises a centrifugal clutch disposed on said drive pulley and provided with a centrifugal ratchet that operates to disengage from said cam by a centrifugal force.

3. The recoil starter according to claim 1, wherein said clutch mechanism comprises a one-way clutch provided with a ratchet that is provided on said cam so as to engage with or disengage from an engagement portion formed on said drive pulley.

4. The recoil starter according to claim 1, wherein said cushioning and force accumulating means comprises a spiral spring that has one end thereof held on said rope reel and the other end thereof held on said cam.

5. The recoil starter according to claim 2, wherein said cushioning and force accumulating means comprises a spiral spring that has one end thereof held on said rope reel and the other end thereof held on said cam.

6. The recoil starter according to claim 3, wherein said cushioning and force accumulating means comprises a spiral spring that has one end thereof held on said rope reel and the other end thereof held on said cam.

7. The recoil starter according to claim 1, wherein said ratchet mechanism includes a ratchet member having a ratchet pawl integrally formed thereon to be engageable with an engagement member formed on an outer periphery of said cam, and an operating member having an operating piece for operating said ratchet member to rotate it, said ratchet member and said operating member each being pivotally supported on a side surface of an outer peripheral portion of said rope reel;

said operating piece is formed on said operating member so as to pivotally rotate said operating member by engaging with one of cutout grooves formed on an inner circumference surface of an outer wall of said casing;

when said rope reel is rotated in the engine starting direction, said operating piece of said operating member engages with one of said cutout grooves, to thereby pivotally rotate said operating member in a direction in which said ratchet pawl is disengaged from said engagement member; and when said rope reel is rotated in the direction in which said recoil rope is rewound, said operating piece of said operating member engages with one of said cutout grooves, to thereby pivotally rotate said operating member in a direction in which said ratchet pawl of said ratchet member is engaged with said engagement member of said cam.

8. The recoil starter according to claim 2, wherein said ratchet mechanism includes a ratchet member having a ratchet pawl integrally formed thereon to be engageable with an engagement member formed on an outer periphery of said cam, and an operating member having an operating piece for operating said ratchet member to rotate it, said ratchet member and said operating member each being pivotally supported on a side surface of an outer peripheral portion of said rope reel;

said operating piece is formed on said operating member so as to pivotally rotate said operating member by engaging with one of cutout grooves formed on an inner circumference surface of an outer wall of said casing;

when said rope reel is rotated in the engine starting direction, said operating piece of said operating member engages with one of said cutout grooves, to thereby pivotally rotate said operating member in a direction in which said ratchet pawl is disengaged from said engagement member; and when said rope reel is rotated in the direction in which said recoil rope is rewound, said operating piece of said operating member engages with one of said cutout grooves, to thereby pivotally rotate said operating member in a direction in which said ratchet pawl of said ratchet member is engaged with said engagement member of said cam.

9. The recoil starter according to claim 3, wherein said ratchet mechanism includes a ratchet member having a ratchet pawl integrally formed thereon to be engageable with an engagement member formed on an outer periphery of said cam, and an operating member having an operating piece for operating said ratchet member to rotate it, said ratchet member and said operating member each being pivotally supported on a side surface of an outer peripheral portion of said rope reel;

said operating piece is formed on said operating member so as to pivotally rotate said operating member by engaging with one of cutout grooves formed on an inner circumference surface of an outer wall of said casing;

when said rope reel is rotated in the engine starting direction, said operating piece of said operating member engages with one of said cutout grooves, to thereby pivotally rotate said operating member in a direction in which said ratchet pawl is disengaged from said engagement member; and when said rope reel is rotated in the direction in which said recoil rope is rewound, said operating piece of said operating member engages with one of said cutout grooves, to thereby pivotally rotate said operating member in a direction in which said ratchet pawl of said ratchet member is engaged with said engagement member of said cam.

10. The recoil starter according to claim 4, wherein said ratchet mechanism includes a ratchet member having a ratchet pawl integrally formed thereon to be engageable with an engagement member formed on an outer periphery of said cam, and an operating member having an operating piece for operating said ratchet member to rotate it, said ratchet member and said operating member each being pivotally supported on a side surface of an outer peripheral portion of said rope reel;

said operating piece is formed on said operating member so as to pivotally rotate said, operating member by engaging with one of cutout grooves formed on an inner circumference surface of an outer wall of said casing;

when said rope reel is rotated in the engine starting direction, said operating piece of said operating member engages with one of said cutout grooves, to thereby pivotally rotate said operating member in a direction in which said ratchet pawl is disengaged from said engagement member; and when said rope reel is rotated in the direction in which said recoil rope is rewound, said operating piece of said operating member, engages with one of said cutout grooves, to thereby pivotally rotate said operating member in a direction in which said ratchet pawl of said ratchet member is engaged with said engagement member of said cam.

11. The recoil starter according to claim 1, wherein said ratchet mechanism comprises a ratchet member swingably supported on a side surface of an outer peripheral portion of said rope reel and provided with a ratchet pawl engageable with an engagement member formed on an outer periphery of said cam, and a biasing means for biasing said ratchet member such that said ratchet member comes into contact with and slides on an inner circumferential surface of an outer wall of said casing;

when said rope reel is rotated in the engine starting direction, said ratchet member swings due to friction between said ratchet member and said inner circumferential surface of said casing such that said ratchet pawl is disengaged from said engagement member of said cam; and when said rope reel is rotated in the direction in which said recoil rope is rewound, said ratchet member swings due to the friction between said ratchet member and said inner circumferential surface of said casing such that said ratchet pawl is engaged with said engagement member of said cam.

12. The recoil starter according to claim 2, wherein said ratchet mechanism comprises a ratchet member swingably supported on a side surface of an outer peripheral portion of said rope reel and provided with a ratchet pawl engageable with an engagement member formed on an outer periphery of said cam, and a biasing means for biasing said ratchet member such that said ratchet member comes into contact with and slides on an inner circumferential surface of an outer wall of said casing;

when said rope reel is rotated in the engine starting direction, said ratchet member swings due to friction between said ratchet member and said inner circumferential surface of said casing such that said ratchet pawl is disengaged from said engagement member of said cam; and when said rope reel is rotated in the direction in which said recoil rope is rewound, said ratchet member swings due to the friction between said ratchet member and said inner circumferential surface of said casing such that said ratchet pawl is engaged with said engagement member of said cam.

13. The recoil starter according to claim 3, wherein said ratchet mechanism comprises a ratchet member swingably supported on a side surface of an outer peripheral portion of said rope reel and provided with a ratchet pawl engageable with an engagement member formed on an outer periphery of said cam, and a biasing means for biasing said ratchet member such that said ratchet member comes into contact with and slides on an inner circumferential surface of an outer wall of said casing;

when said rope reel is rotated in the engine starting direction, said ratchet member swings due to friction between said ratchet member and said inner circumferential surface of said casing such that said ratchet pawl is disengaged from said engagement member of said cam; and when said rope reel is rotated in the direction in which said recoil rope is rewound, said ratchet member swings due to the friction between said ratchet member and said inner circumferential surface of said casing such that said ratchet pawl is engaged with said engagement member of said cam.

14. The recoil starter according to claim 4, wherein said ratchet mechanism comprises a ratchet member swingably supported on a side surface of an outer peripheral portion of said rope reel and provided with a ratchet pawl engageable with an engagement member formed on an outer periphery of said cam, and a biasing means for biasing said ratchet member such that said ratchet member comes into contact with and slides on an inner circumferential surface of an outer wall of said casing;

when said rope reel is rotated in the engine starting direction, said ratchet member swings due to friction between said ratchet member and said inner circumferential surface of said casing such that said ratchet pawl is disengaged from said engagement member of said cam; and when said rope reel is rotated in the direction in which said recoil rope is rewound, said ratchet member swings due to the friction between said ratchet member and said inner circumferential surface of said casing such that said ratchet pawl is engaged with said engagement member of said cam.

15. The recoil starter according to claim 1, wherein said ratchet mechanism comprises a ratchet member pivotally supported on a side surface of said rope reel via a pivot and provided at one end thereof with a ratchet pawl engageable with an engagement member formed on an outer periphery of said cam, and a biasing spring piece having a curved shape and supported at opposite ends thereof on said ratchet member while a curved portion of said biasing spring piece is kept in sliding contact with an inner circumferential surface of an outer wall of said casing;

when said rope reel is rotated in the engine starting direction, said ratchet pawl is disengaged from said engagement member of said cam due to a sliding resistance between said curved portion of said biasing spring piece and said inner circumferential surface of said casing; and when said rope reel is rotated in the direction in which said recoil rope is rewound, said ratchet member is pivotally rotated about said pivot due to the sliding resistance between said curved portion of said biasing spring piece and said inner circumferential surface of said casing such that said ratchet pawl is engaged with said engagement member of said cam.

16. The recoil starter according to claim 2, wherein said ratchet mechanism comprises a ratchet member pivotally supported on a side surface of said rope reel via a pivot and provided at one end thereof with a ratchet pawl engageable with an engagement member formed on an outer periphery of said cam, and a biasing spring piece having a curved shape and supported at opposite ends thereof on said ratchet member while a curved portion of said biasing spring piece is kept in sliding contact with an inner circumferential surface of an outer wall of said casing;

when said rope reel is rotated in the engine starting direction, said ratchet pawl is disengaged from said engagement member of said cam due to a sliding resistance between said curved portion of said biasing spring piece and said inner circumferential surface of said casing; and when said rope reel is rotated in the direction in which said recoil rope is rewound, said ratchet member is pivotally rotated about said pivot due to the sliding resistance between said curved portion of said biasing spring piece and said inner circumferential surface of said casing such that said ratchet pawl is engaged with said engagement member of said cam.

17. The recoil starter according to claim 3, wherein said ratchet mechanism comprises a ratchet member pivotally supported on a side surface of said rope reel via a pivot and provided at one end thereof with a ratchet pawl engageable with an engagement member formed on an outer periphery of said cam, and a biasing spring piece having a curved shape and supported at opposite ends thereof on said ratchet member while a curved portion of said biasing spring piece is kept in sliding contact with an inner circumferential surface of an outer wall of said casing;

when said rope reel is rotated in the engine starting direction, said ratchet pawl is disengaged from said engagement member of said cam due to a sliding resistance between said curved portion of said biasing spring piece and said inner circumferential surface of said casing; and when said rope reel is rotated in the direction in which said recoil rope is rewound, said ratchet member is pivotally rotated about said pivot due to the sliding resistance between said curved portion of said biasing spring piece and said inner circumferential surface of said casing such that said ratchet pawl is engaged with said engagement member of said cam.

18. The recoil starter according to claim 4, wherein said ratchet mechanism comprises a ratchet member pivotally supported on a side surface of said rope reel via a pivot and provided at one end thereof with a ratchet pawl engageable with an engagement member formed on an outer periphery of said cam, and a biasing spring piece having a curved shape and supported at opposite ends thereof on said ratchet member while a curved portion of said biasing spring piece is kept in sliding contact with an inner circumferential surface of an outer wall of said casing;

when said rope reel is rotated in the engine starting direction, said ratchet pawl is disengaged from said en member of said cam due to a sliding resistance between said curved portion of said biasing spring piece and said inner circumferential surface of said casing; and when said rope reel is rotated in the direction in which said recoil rope is rewound, said ratchet member is pivotally rotated about said pivot due to the sliding resistance between said curved portion of said biasing spring piece and said inner circumferential surface of said casing such that said ratchet pawl is engaged with said engagement member of said cam.

19. A recoil starter for use on a hand started engine, comprising:

a casing having a reel shaft formed therein and adapted to be mounted to an engine;

a rope reel rotatably supported on said reel shaft and provided on an outer periphery thereof with a drum portion around which a recoil rope is wound;

a recoil spring for rotationally urging said rope reel in a direction in which said recoil rope is rewound;

a cam engageable, via a clutch mechanism, with a drive pulley coupled to the engine, for transmitting a rotation thereof to said drive pulley;

a cushioning and force accumulating unit interposed between said rope reel and said cam, for storing a rotational force transmitted via said cam by said drive pulley, to assist in starting the engine; and a ratchet mechanism is provided between said rope reel and said cam such that, when said rope reel is rotated in an engine starting direction, said ratchet mechanism uncouples said rope reel and said cam from each other, and when said rope reel is rotated in the direction opposite to the engine starting direction by the rotational force accumulated in said recoil spring, said ratchet mechanism couples said rope reel and said cam to each other so that said cam is rotated together with said rope reel in said opposite direction.

20. The recoil starter according to claim 19 wherein its ratchet mechanism includes an integral ratchet panel that can pivot into and out of engagement with an engagement member operatively connected to the cam and the cushioning and force accumulating unit includes a spiral spring operatively connected to the rope reel and the cam.

* * * * *